US009293245B2

(12) United States Patent
Stephanou et al.

(10) Patent No.: US 9,293,245 B2
(45) Date of Patent: Mar. 22, 2016

(54) INTEGRATION OF A COIL AND A DISCONTINUOUS MAGNETIC CORE

(71) Applicant: QUALCOMM MEMS Technologies, Inc., San Diego, CA (US)

(72) Inventors: Philip Jason Stephanou, Mountain View, CA (US); Jitae Kim, Mountain View, CA (US); Ravindra Vaman Shenoy, Dublin, CA (US); Kwan-yu Lai, Campbell, CA (US)

(73) Assignee: QUALCOMM MEMS Technologies, Inc., San Diego, CA (US)

( * ) Notice: Subject to any disclaimer, the term of this patent is extended or adjusted under 35 U.S.C. 154(b) by 132 days.

(21) Appl. No.: 13/958,645

(22) Filed: Aug. 5, 2013

(65) Prior Publication Data

US 2015/0035638 A1 Feb. 5, 2015

(51) Int. Cl.

| | |
|---|---|
| ***H01F 5/00*** | (2006.01) |
| ***H01F 27/28*** | (2006.01) |
| ***H01F 21/06*** | (2006.01) |
| ***H01F 27/24*** | (2006.01) |
| ***H01F 41/04*** | (2006.01) |
| ***H01F 17/00*** | (2006.01) |

(52) U.S. Cl.

CPC ..... *H01F 27/2804* (2013.01); *H01F 17/0033* (2013.01); *H01F 27/24* (2013.01); *H01F 41/041* (2013.01); *H01F 2017/004* (2013.01); *H01F 2017/0066* (2013.01); *H01F 2027/2809* (2013.01)

(58) Field of Classification Search

CPC ..... H01F 2027/2819; H01F 2017/0066

USPC ..... 336/200, 223, 232

See application file for complete search history.

(56) References Cited

U.S. PATENT DOCUMENTS 5,793,272 A 8/1998 Burghartz et al.
7,785,697 B2 * 8/2010 Masai et al. ..... 428/172

(Continued)

FOREIGN PATENT DOCUMENTS

EP 2500917 A2 9/2012
WO WO-2011149520 A1 12/2011

(Continued)

OTHER PUBLICATIONS

International Search Report and Written Opinion—PCT/US2014/049103—ISA/EPO—Oct. 24, 2014.

(Continued)

*Primary Examiner* — Elvin G Enad
*Assistant Examiner* — Ronald Hinson
(74) *Attorney, Agent, or Firm* — Weaver Austin Villeneuve & Sampson, LLP

(57) ABSTRACT

A particular device includes a coil and a discontinuous magnetic core. The discontinuous magnetic core includes a first elongated portion, a second elongated portion, and at least two curved portions, where the portions are coplanar and physically separated from each other. The discontinuous magnetic core is arranged to form a discontinuous loop. The discontinuous magnetic core is deposited as a first layer above a dielectric substrate. A first portion of the coil extends above a first surface of the magnetic core. A second portion of the coil extends below a second surface of the magnetic core. The second portion of the coil is electrically coupled to the first portion of the coil. The second surface of the magnetic core is opposite the first surface of the magnetic core.

42 Claims, 14 Drawing Sheets

(56) References Cited

U.S. PATENT DOCUMENTS

| | | | | |
|---|---|---|---|---|
| 8,068,004 | B1 * | 11/2011 | Chong et al. | 336/222 |
| 2002/0037434 | A1 | 3/2002 | Feygenson et al. | |
| 2003/0070282 | A1 * | 4/2003 | Hiatt et al. | 29/602.1 |
| 2008/0129437 | A1 * | 6/2008 | Yoshizawa et al. | 336/220 |
| 2008/0238601 | A1 | 10/2008 | Das et al. | |
| 2009/0002117 | A1 | 1/2009 | Kawarai | |
| 2009/0068400 | A1 | 3/2009 | Lotfi et al. | |
| 2009/0085706 | A1 | 4/2009 | Baarman et al. | |
| 2009/0129027 | A1 | 5/2009 | Malik | |
| 2011/0217793 | A1 | 9/2011 | Takahashi et al. | |
| 2013/0027170 | A1 | 1/2013 | Chen | |

FOREIGN PATENT DOCUMENTS

| | | | |
|---|---|---|---|
| WO | WO-2013025878 | A1 | 2/2013 |
| WO | WO-2013109889 | A2 | 7/2013 |

OTHER PUBLICATIONS

Frommberger, et al., "Integration of Crossed Anisotropy Magnetic Core Into Toroidal Thin-Film Inductors," IEEE Transactions on Microwave Theory and Techniques, vol. 53, No. 6, Jun. 2005, pp. 2096-2100.

Hettstedt F., et al., "Toroid Microinductors Using Segmented Magnetic Cores," IEEE MTT-S International Microwave Symposium Digest (MTT), 2010, pp. 1348-1351.

Kubik J., et al., "PCB racetrack fluxgate sensor with improved temperature stability," Sensors and Actuators A: Physical, Aug. 14, 2006, 4 pages.

Masai, et al., "Effect of Slit Patterning Perpendicular to Magnetic Easy Axis in Thin Film Inductors," IEEE Transactions on Magnetics, vol. 44, No. 11, Nov. 2008, pp. 3871-3874.

Wang, et al., "Integrated magnets on silicon for power supply in package (PSiP) and power supply on chip (PwrSoC)," 3rd Electronic System-Integration Technology Conference (ESTC), 2010, pp. 1-6.

* cited by examiner

INTEGRATION OF A COIL AND A DISCONTINUOUS MAGNETIC CORE

I. FIELD

The present disclosure is generally related to an integration of a coil and a discontinuous magnetic core.

II. DESCRIPTION OF RELATED ART

Advances in technology have resulted in smaller and more powerful computing devices. For example, there currently exist a variety of portable personal computing devices, including wireless computing devices, such as portable wireless telephones, personal digital assistants (PDAs), and paging devices that are small, lightweight, and easily carried by users. More specifically, portable wireless telephones, such as cellular telephones and internet protocol (IP) telephones, can communicate voice and data packets over wireless networks. Further, many such wireless telephones include other types of devices that are incorporated therein. For example, a wireless telephone can also include a digital still camera, a digital video camera, a digital recorder, and an audio file player. Also, such wireless telephones can process executable instructions, including software applications, such as a web browser application, that can be used to access the Internet. As such, these wireless telephones can include significant computing capabilities.

Inductors are used in power regulation, frequency control and signal conditioning applications in many electronic devices (e.g., personal computers, tablet computers, wireless mobile handsets, and wireless telephones). Some inductors are fabricated with cores made of materials with high relative magnetic permeability, increasing an inductance density and reducing area requirements associated with the inductors. When electric current flows through a coil of an inductor, magnetic flux lines may be created. Magnetic flux lines form closed loops, so magnetic cores may provide closed loop, high permeability flux paths. Open flux paths may create demagnetizing fields that limit an effective permeability of a core.

Some core materials exhibit uniaxial anisotropy. A uniaxial material may possess a hard axis and an easy axis, where the hard axis is orthogonal to the easy axis. The hard axis may be characterized by a high magnetic permeability. The easy axis may be characterized by a high magnetic permeability when the coils conduct an alternating current having a frequency lower than an easy axis roll-off frequency and may be characterized by a lower magnetic permeability when the coils conduct an alternating current having a frequency higher than the easy axis roll-off frequency. Accordingly, a physically closed (e.g., a closed loop), uniaxial magnetic core may not provide a closed loop, high permeability flux path when the coils conduct an alternating current having a frequency higher than the easy axis roll-off frequency.

III. SUMMARY

This disclosure presents embodiments of an inductor that includes a coil and a discontinuous magnetic core. The magnetic core may have a "racetrack toroid" configuration. For example, the magnetic core may include at least two curved portions, a first elongated portion, and a second elongated portion, arranged to form a discontinuous loop. The magnetic core may be magnetically anisotropic. The magnetic core may include, for example, a plurality of physically separated segments disposed along an easy axis of the magnetic core.

Conductive elements of the coil may coil around the magnetic core. An electronic device (e.g., a mobile phone) may use the inductor to produce a higher effective inductance when the coil conducts an alternating current having a frequency higher than an easy axis roll-off frequency associated with the magnetic core, as compared to an electronic device that includes an inductor but does not include the magnetic core, or as compared to an electronic device that includes an inductor that includes a uniaxial magnetic core that is continuous.

In a particular embodiment, a method includes forming a first magnetic core deposited as a first discontinuous layer above a dielectric substrate. The first magnetic core includes a first elongated portion. The first magnetic core further includes a second elongated portion that is physically separated from the first elongated portion. The first magnetic core further includes at least two curved portions that are physically separated from the first elongated portion and from the second elongated portion. The at least two curved portions are substantially coplanar with the first elongated portion and the second elongated portion. The at least two curved portions, the first elongated portion, and the second elongated portion are arranged to form a discontinuous loop. The method further includes forming a first coil. A first portion of the first coil extends above a first surface of the first magnetic core. A second portion of the first coil extends below a second surface of the first magnetic core. The second portion of the first coil is coupled to the first portion of the first coil, such as through a via, to form a continuous path for electrical conduction. The second surface of the first magnetic core is opposite the first surface of the first magnetic core.

In another particular embodiment, an apparatus includes a first magnetic core. The first magnetic core includes a first elongated portion. The first magnetic core further includes a second elongated portion that is physically separated from the first elongated portion. The first magnetic core further includes at least two curved portions that are physically separated from the first elongated portion and from the second elongated portion. The at least two curved portions are substantially coplanar with the first elongated portion and the second elongated portion. The at least two curved portions, the first elongated portion, and the second elongated portion are arranged to form a discontinuous loop. The apparatus further includes a dielectric substrate. The first magnetic core is deposited as a first discontinuous layer above the dielectric substrate. The apparatus further includes a first coil. A first portion of the first coil extends above a first surface of the first magnetic core. A second portion of the first coil extends below a second surface of the first magnetic core. The second portion of the first coil is coupled to the first portion of the first coil, such as through a via, to form a continuous path for electrical conduction. The second surface of the first magnetic core is opposite the first surface of the first magnetic core.

In another particular embodiment, a method includes forming a magnetic core deposited as a discontinuous layer above a dielectric substrate. The magnetic core is magnetically anisotropic. The magnetic core includes a plurality of physically separated segments disposed along an easy axis of the magnetic core. The method further includes forming a coil. A first portion of the coil extends above a first surface of the magnetic core. A second portion of the coil extends below a second surface of the magnetic core. The second portion of the coil is coupled to the first portion of the coil, such as through a via, to form a continuous path for electrical conduction. The second surface of the magnetic core is opposite the first surface of the magnetic core.

In another particular embodiment, an apparatus includes a magnetic core that is magnetically anisotropic. The magnetic core includes a plurality of physically separated segments disposed along an easy axis of the magnetic core. The apparatus further includes a dielectric substrate. The magnetic core is deposited as a layer above the dielectric substrate. The apparatus further includes a coil. A first portion of the coil extends above a first surface of the magnetic core. A second portion of the coil extends below a second surface of the magnetic core. The second portion of the coil is coupled to the first portion of the coil, such as through a via, to form a continuous path for electrical conduction. The second surface of the magnetic core is opposite the first surface of the magnetic core.

In another particular embodiment, a method includes a step for forming a magnetic core deposited as a discontinuous layer above a dielectric substrate. The magnetic core includes a first elongated portion. The magnetic core further includes a second elongated portion that is physically separated from the first elongated portion. The magnetic core further includes at least two curved portions that are physically separated from the first elongated portion and from the second elongated portion. The at least two curved portions are substantially coplanar with the first elongated portion and the second elongated portion. The at least two curved portions, the first elongated portion, and the second elongated portion are arranged to form a discontinuous loop. The method further includes a step for forming a coil. A first portion of the coil extends above a first surface of the magnetic core. A second portion of the coil extends below a second surface of the magnetic core. The second portion of the coil is coupled to the first portion of the coil, such as through a via, to form a continuous path for electrical conduction. The second surface of the magnetic core is opposite the first surface of the magnetic core.

In another particular embodiment, an apparatus includes means for inducing a magnetic field. The apparatus further includes means for guiding the magnetic field. The means for guiding the magnetic field includes a first elongated portion. The means for guiding the magnetic field further includes a second elongated portion that is physically separated from the first elongated portion. The means for guiding the magnetic field further includes at least two curved portions that are physically separated from the first elongated portion and from the second elongated portion. The at least two curved portions are substantially coplanar with the first elongated portion and the second elongated portion. The at least two curved portions, the first elongated portion, and the second elongated portion are arranged to form a discontinuous loop. The apparatus further includes means for supporting layers. The means for guiding the magnetic field is deposited as a discontinuous layer above the means for supporting layers. A first portion of the means for inducing the magnetic field extends above a first surface of the means for guiding the magnetic field. A second portion of the means for inducing the magnetic field extends below a second surface of the means for guiding the magnetic field. The second portion of the means for inducing the magnetic field is coupled to the first portion of the means for inducing the magnetic field, such as through a via, to form a continuous path for electrical conduction. The second surface of the means for guiding the magnetic field is opposite the first surface of the means for guiding the magnetic field.

In another particular embodiment, a method includes a step for forming a magnetic core deposited as a discontinuous layer above a dielectric substrate. The magnetic core is magnetically anisotropic. The magnetic core includes a plurality of physically separated segments disposed along an easy axis of the magnetic core. The method further includes a step for forming a coil. A first portion of the coil extends above a first surface of the magnetic core. A second portion of the coil extends below a second surface of the magnetic core. The second portion of the coil is coupled to the first portion of the coil, such as through a via, to form a continuous path for electrical conduction. The second surface of the magnetic core is opposite the first surface of the magnetic core.

In another particular embodiment, an apparatus includes means for inducing a magnetic field. The apparatus further includes means for guiding the magnetic field. The means for guiding the magnetic field is magnetically anisotropic. The means for guiding the magnetic field includes a plurality of physically separated segments disposed along an easy axis of the means for guiding the magnetic field. The apparatus further includes means for supporting layers. The means for guiding the magnetic field is deposited as a discontinuous layer above the means for supporting layers. A first portion of the means for inducing the magnetic field extends above a first surface of the means for guiding the magnetic field. A second portion of the means for inducing the magnetic field extends below a second surface of the means for guiding the magnetic field. The second portion of the means for inducing the magnetic field is coupled to the first portion of the means for inducing the magnetic field, such as through a via, to form a continuous path for electrical conduction. The second surface of the means for guiding the magnetic field is opposite the first surface of the means for guiding the magnetic field.

In another particular embodiment, a non-transitory computer readable medium includes instructions that, when executed by a processor, cause the processor to initiate formation of a magnetic core deposited as a discontinuous layer above a dielectric substrate. The magnetic core includes a first elongated portion. The magnetic core further includes a second elongated portion that is physically separated from the first elongated portion. The magnetic core further includes at least two curved portions that are physically separated from the first elongated portion and from the second elongated portion. The at least two curved portions are substantially coplanar with the first elongated portion and the second elongated portion. The at least two curved portions, the first elongated portion, and the second elongated portion are arranged to form a discontinuous loop. The non-transitory computer readable medium further includes instructions that, when executed by the processor, cause the processor to initiate formation of a coil. A first portion of the coil extends above a first surface of the magnetic core. A second portion of the coil extends below a second surface of the magnetic core. The second portion of the coil is coupled to the first portion of the coil, such as through a via, to form a continuous path for electrical conduction. The second surface of the magnetic core is opposite the first surface of the magnetic core.

In another particular embodiment, a non-transitory computer readable medium includes instructions that, when executed by a processor, cause the processor to initiate formation of a magnetic core deposited as a discontinuous layer above a dielectric substrate. The magnetic core is magnetically anisotropic. The magnetic core includes a plurality of physically separated segments disposed along an easy axis of the magnetic core. The non-transitory computer readable medium further includes instructions that, when executed by the processor, cause the processor to initiate formation of a coil. A first portion of the coil extends above a first surface of the magnetic core. A second portion of the coil extends below a second surface of the magnetic core. The second portion of the coil is coupled to the first portion of the coil, such as through a via, to form a continuous path for electrical conduction. The second surface of the magnetic core is opposite the first surface of the magnetic core.

In another particular embodiment, a method includes receiving a data file including design information corresponding to an electronic device. The method further includes fabricating the electronic device according to the design information. The electronic device includes a magnetic core. The magnetic core includes a first elongated portion. The magnetic core further includes a second elongated portion that is physically separated from the first elongated portion. The magnetic core further includes at least two curved portions that are physically separated from the first elongated portion and from the second elongated portion. The at least two curved portions are substantially coplanar with the first elongated portion and the second elongated portion. The at least two curved portions, the first elongated portion, and the second elongated portion are arranged to form a discontinuous loop. The electronic device further includes a dielectric substrate. The magnetic core is deposited as a discontinuous layer above the dielectric substrate. The electronic device further includes a coil. A first portion of the coil extends above a first surface of the magnetic core. A second portion of the coil extends below a second surface of the magnetic core. The second portion of the coil is coupled to the first portion of the coil, such as through a via, to form a continuous path for electrical conduction. The second surface of the magnetic core is opposite the first surface of the magnetic core.

In another particular embodiment, a method includes receiving a data file including design information corresponding to an electronic device. The method further includes fabricating the electronic device according to the design information. The electronic device includes a magnetic core. The magnetic core is magnetically anisotropic. The magnetic core includes a plurality of physically separated segments disposed along an easy axis of the magnetic core. The electronic device further includes a dielectric substrate. The magnetic core is deposited as a layer above the dielectric substrate. The electronic device further includes a coil. A first portion of the coil extends above a first surface of the magnetic core. A second portion of the coil extends below a second surface of the magnetic core. The second portion of the coil is coupled to the first portion of the coil, such as through a via, to form a continuous path for electrical conduction. The second surface of the magnetic core is opposite the first surface of the magnetic core.

One particular advantage provided by at least one of the disclosed embodiments is that an electronic device including an inductor that includes a coil and a discontinuous magnetic core may be configured to use the inductor to produce a higher effective inductance when the coil conducts a current (e.g., an alternating current) having a frequency higher than an easy axis roll-off frequency associated with the magnetic core, as compared to an electronic device that includes an inductor but does not include the magnetic core, or as compared to an electronic device that includes an inductor and a uniaxial magnetic core that is continuous.

Other aspects, advantages, and features of the present disclosure will become apparent after review of the entire application, including the following sections: Brief Description of the Drawings. Detailed Description, and the Claims.

IV. BRIEF DESCRIPTION OF THE DRAWINGS

V. DETAILED DESCRIPTION

Figure 1:
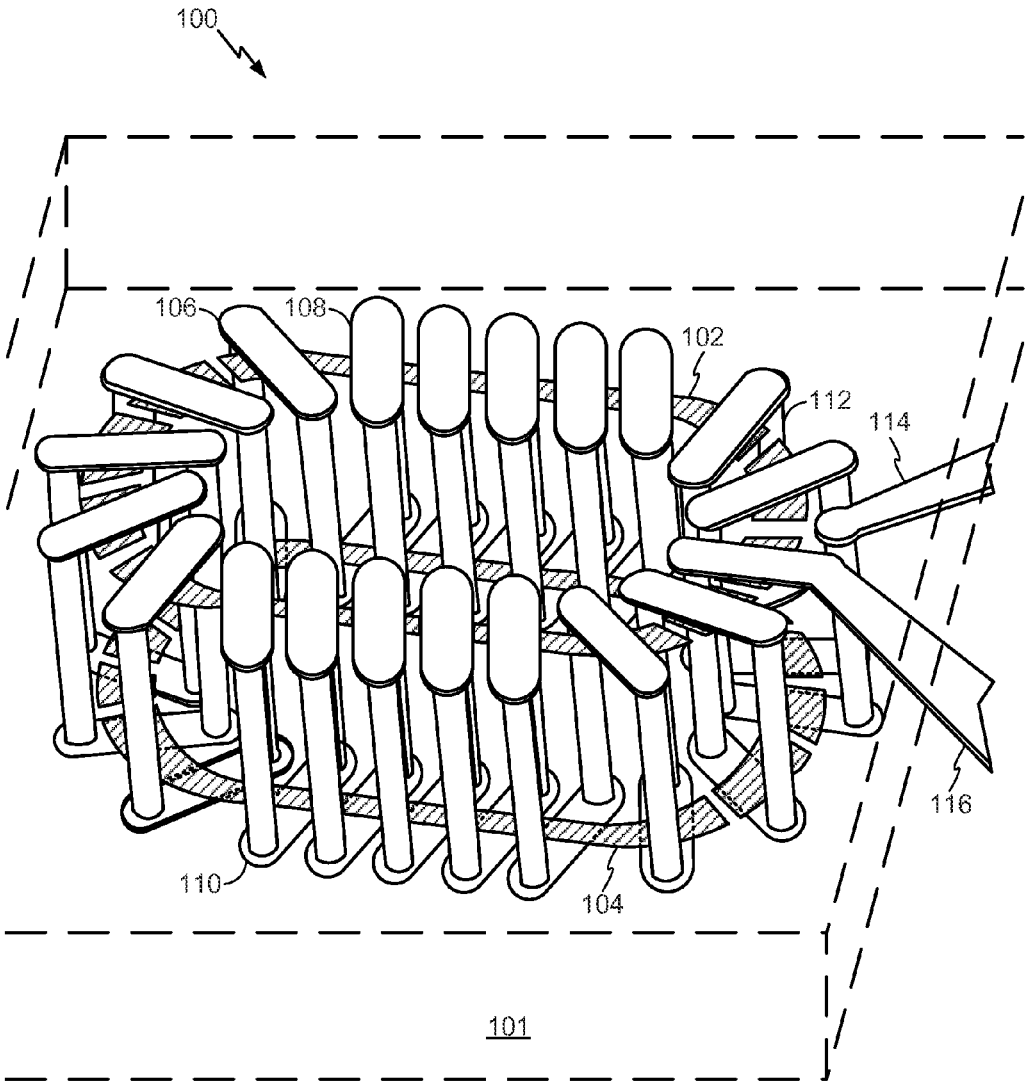
FIG. 1 is a diagram showing a particular embodiment of a structure that includes a coil and two discontinuous magnetic cores.

Referring to FIG. 1, a particular illustrative embodiment of an inductor 100 is shown. The inductor 100 includes at least one magnetic core (e.g., a first magnetic core 102 and/or a second magnetic core 104) and a coil 106. The at least one magnetic core may be configured to increase an effective inductance value associated with the inductor 100 when a current (e.g., an alternating current) is applied to the coil 106. The at least one magnetic core may have racetrack toroid shape (also referred to as an elongated elliptical shape or a "stadium" shape). The at least one magnetic core may be a uniaxial core (i.e., formed of a uniaxial magnetic material). The at least one magnetic core may be deposited as a discontinuous layer above a dielectric substrate (e.g., the dielectric substrate 101). A first portion 108 of the coil 106 may extend above a first surface of the at least one magnetic core and a second portion 110 of the coil 106 may extend below a second surface of the at least one magnetic core, where the second surface is opposite the first surface. The coil 106 may further include one or more vias 112, where the one or more vias 112 are at least partially filled with an electrically conductive material. The one or more vias 112 may be vertical components of the coil 106 and may be coupled between the first portion 108 and the second portion 110. For example, conductive elements of the coil 106 may coil around the at least one magnetic core, as illustrated in FIG. 1. The coil 106 may be electrically continuous between a first metal segment 114 and a second metal segment 116. In a particular embodiment, a first portion of another coil (not shown) may extend above the first surface of the at least one magnetic core and a second portion of the other coil may extend below the second surface of the at least one magnetic core. For example, the coil 106 and the other coil may be interspersed and may form a transformer.

Figure 2:
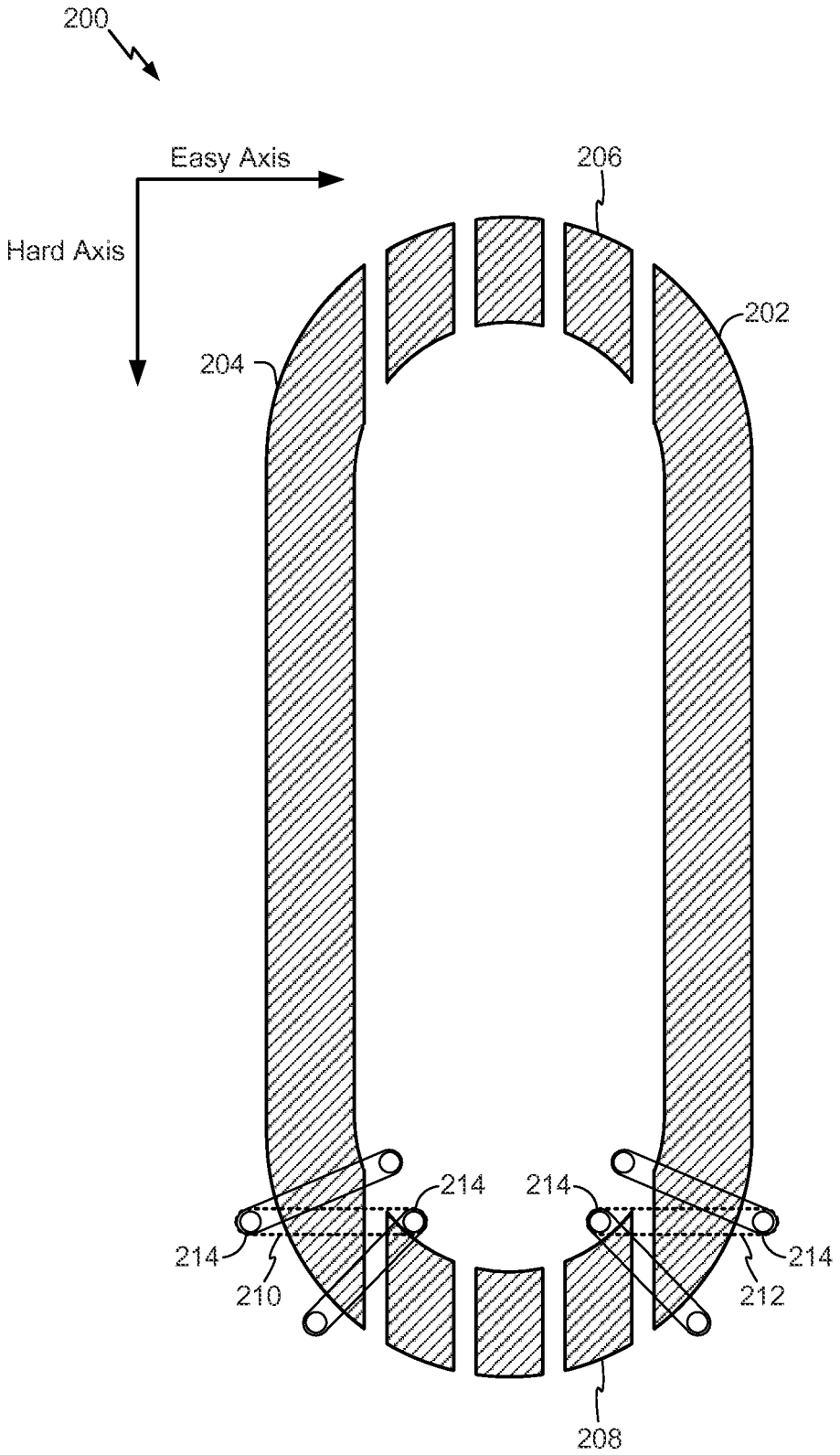
FIG. 2 is a diagram showing a top view of a particular embodiment of a discontinuous magnetic core.

In a particular embodiment, the first magnetic core 102 includes a plurality of physically separated segments, as described further with reference to FIG. 2. In a particular embodiment, the first magnetic core 102 is deposited as a first discontinuous layer above a first surface of the dielectric substrate 101, as described further with reference to FIG. 3. In a particular embodiment, the first magnetic core 102 is formed from a single deposition layer above the dielectric substrate 101. In a particular embodiment, one or more electrical insulators are disposed between the plurality of physically separated segments of the first magnetic core 102. In a particular embodiment, the first magnetic core 102 is magnetically anisotropic and the plurality of physically separated segments is disposed along an easy axis of the first magnetic core 102.

The physical separation of the segments of the first magnetic core 102 may increase a magnetic domain wall resonant frequency associated with the easy axis of the first magnetic core 102 as compared to a physically continuous magnetic core. Increasing the magnetic domain wall resonant frequency associated with the easy axis of the first magnetic core 102 may increase a magnetic permeability associated with the first magnetic core 102 when the coil 106 conducts a current having a frequency higher than an easy axis roll-off frequency associated with the first magnetic core 102. In a particular embodiment, a magnetic permeability associated with the easy axis of the first magnetic core 102 is substantially the same as a magnetic permeability associated with a hard axis of the first magnetic core 102.

The conductive elements of the coil 106 may be coiled around the first magnetic core 102, the second magnetic core 104, or both. In a particular embodiment, when the conductive elements of the coil 106 coil around the first magnetic core 102 and coil around the second magnetic core 104, an effective inductance value associated with the inductor 100 may be larger than an effective inductance associated with coiling the conductive elements of the coil 106 around the first magnetic core 102 or around the second magnetic core 104 separately. In a particular embodiment, the second magnetic core 104 is deposited above the first surface of the dielectric substrate 101, as described further with reference to FIG. 7. Alternatively, the second magnetic core 104 may be deposited below a second surface of the dielectric substrate 101, where the second surface of the dielectric substrate 101 is opposite the first surface of the dielectric substrate 101, as described further with reference to FIG. 8. The second magnetic core 104 may include a plurality of physically separated segments, as described further with reference to FIG. 2. Alternatively, the second magnetic core 104 may be continuous (e.g., the second magnetic core 104 is not formed of a plurality of physically separated segments). One or more electrical insulators may be disposed between the second plurality of physically separated segments.

The physical separation of the segments of the second magnetic core 104 may increase a magnetic domain wall resonant frequency associated with an easy axis of the second magnetic core 104 as compared to a physically continuous magnetic core. Increasing the magnetic domain wall resonant frequency associated with the easy axis of the second magnetic core 104 may increase a magnetic permeability associated with the second magnetic core 104 when the coil 106 conducts a current having a frequency higher than an easy axis roll-off frequency associated with the second magnetic core 104. In a particular embodiment, a magnetic permeability associated with the easy axis of the second magnetic core 104 is substantially the same as a magnetic permeability associated with a hard axis of the second magnetic core 104. In a particular embodiment, the second magnetic core 104 is substantially symmetrical to the first magnetic core 102. A plane of symmetry may occur between the first magnetic core 102 and the second magnetic core 104 where the first magnetic core 102 and the second magnetic core 104 are vertically aligned across the plane of symmetry.

An electronic device that incorporates the inductor 100 may be configured to use the inductor 100 to produce a higher effective inductance when the coil 106 conducts a current having a frequency higher than an easy axis roll-off frequency associated with at least one uniaxial magnetic core (e.g., the first magnetic core 102, the second magnetic core 104, or both), as compared to an electronic device that includes an inductor but does not include the at least one magnetic core, or as compared to an electronic device that includes an inductor and a uniaxial magnetic core that is continuous.

Referring to FIG. 2, a top view of a particular illustrative embodiment of a magnetic core 200 is shown. The magnetic core 200 may correspond to the first magnetic core 102 or the second magnetic core 104 of FIG. 1.

The magnetic core 200 may include a first elongated portion 202, a second elongated portion 204 that is physically separated from the first elongated portion 202, and at least two curved portions (206, 208) that are physically separated from the first elongated portion 202 and from the second elongated portion 204. The at least two curved portions (206, 208) may be substantially coplanar with the first elongated portion 202 and with the second elongated portion 204. The at least two curved portions (206, 208), the first elongated portion 202, and the second elongated portion 204 may be arranged to form a discontinuous loop. The magnetic core 200 may have a racetrack toroid shape. Thus, the magnetic core 200 may include a plurality of physically separated segments (e.g., the first elongated portion 202, the first curved portion 206, the second elongated portion 204, and the second curved portion 208) disposed along an easy axis of the magnetic core 200. In a particular embodiment, one or more electrical insulators are disposed between the plurality of physically separated segments. The physical separation associated with the at least two curved portions (206, 208) may increase a magnetic domain wall resonant frequency associated with an easy axis of the magnetic core 200 as compared to a physically continuous magnetic core. Increasing the magnetic domain wall resonant frequency associated with the easy axis of the magnetic core 200 may increase a magnetic permeability associated with the magnetic core 200.

In a particular embodiment, FIGS. 3-11, as described further below, illustrate a side view of a portion of a structure that includes a magnetic core that corresponds to the magnetic core 200 of FIG. 2. The structure may include a coil formed of a first coil layer (such as a first coil layer 210 of FIG. 2), a second coil layer (such as a second coil layer 212 of FIG. 2), and vias (or recesses) (such as vias 214 of FIG. 2) at least partially filled with an electrically conductive material. The coil may extend above the first elongated portion 202 and may extend above the at least two curved portions (206, 208). The coil may correspond to the coil 106 of FIG. 1.

Figure 3:
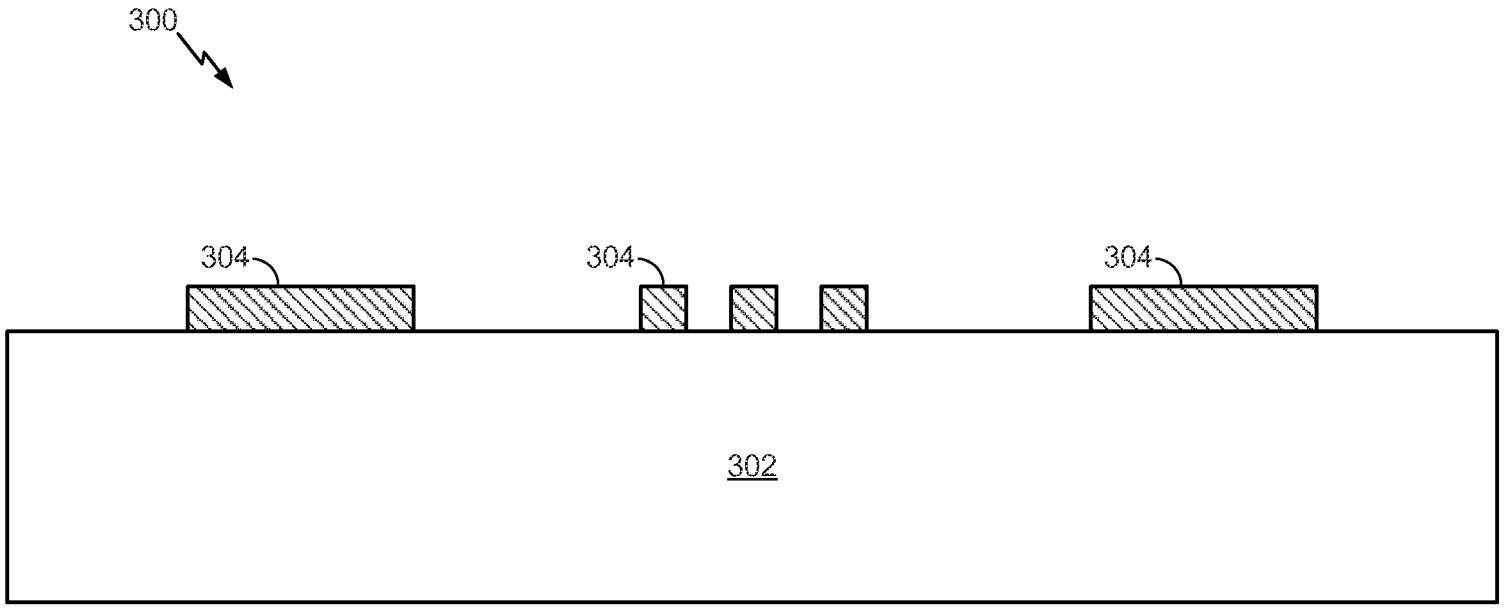
FIG. 3 is a diagram showing a side view of a first illustrative embodiment of a structure during at least one stage in a process of fabricating an electronic device.

Referring to FIG. 3, a first illustrative diagram of a side view of a portion of a structure as formed during at least one stage in a process of fabricating an electronic device is depicted and generally designated 300. FIG. 3 shows a first discontinuous layer 304 deposited above a dielectric substrate 302. In a particular embodiment, the dielectric substrate 302 is formed from a glass-type material (e.g., a non-crystalline or amorphous solid material) with a high electrical resistivity. For example, the dielectric substrate 302 may be formed of an alkaline earth boro-aluminosilicate glass, a glass-based laminate, sapphire ($Al_2O_3$), quartz, a ceramic, or a combination thereof. The dielectric substrate 302 may correspond to the dielectric substrate 101 of FIG. 1.

The first discontinuous layer 304 may be formed using a combination of additive and subtractive processes. Various processes may be used to apply, remove, or pattern layers. For example, film deposition processes, such as chemical vapor deposition (CVD), spin-on, sputtering, and electroplating can be used to form metal layers and inter-metal dielectric layers; photolithography can be used to form patterns of metal layers; etching process can be performed to remove unwanted materials; and planarization processes such as spin-coating, "etch-back," and chemical-mechanical polishing (CMP) can be employed to create a flat surface. Other processes may also or in the alternative be used depending on materials to be added, removed, patterned, doped, or otherwise fabricated. For example, patterning may be used to apply a single layer that forms separate segments of the first discontinuous layer 304.

Figure 5:
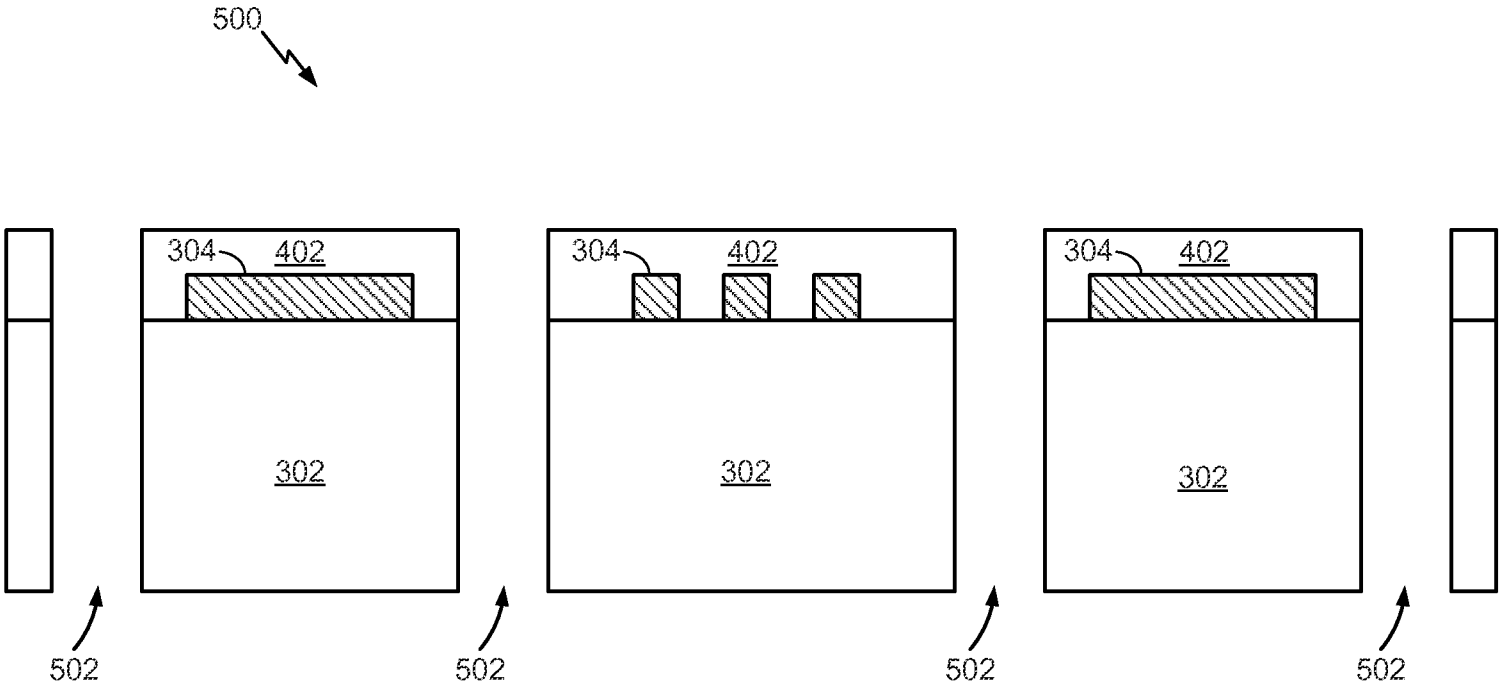
FIG. 5 is a diagram showing a side view of a third illustrative embodiment of a structure during at least one stage in a process of fabricating an electronic device.

The particular process of fabricating the electronic device described here is only one order for forming the electronic device. The electronic device could be formed by performing fabrication steps in another order than the one described. For example, vias (or recesses) 502, as illustrated in FIG. 5 may be formed in the dielectric substrate 302 and at least partially filled with an electrically conductive material to form portions of a first coil layer 602 and/or of a second coil layer 604, as described further with reference to FIG. 6, before the first discontinuous layer 304 is deposited above the dielectric substrate 302. Further, only a limited number of connectors, layers, and other structures or devices are shown in the figures to facilitate illustration and for clarity of the description. In practice, the structure may include more or fewer connectors, layers, and other structures or devices.

The first discontinuous layer 304 may be deposited above the dielectric substrate 302 to form a magnetic core. The magnetic core may correspond to the first magnetic core 102 or the second magnetic core 104 of FIG. 1 or to the magnetic core 200 of FIG. 2. The first discontinuous layer 304 may be formed of Cobalt (Co), Iron (Fe), Tantalum (Ta), Zirconium (Zr), Nickel (Ni), Cobalt Iron (CoFe), Cobalt Tantalum Zirconium (CoTaZr), Nickel Iron (NiFe), or a combination thereof. The first discontinuous layer 304 may be formed by forming a continuous layer using additive processes, such as chemical vapor deposition (CVD), spin-on, sputtering, or electroplating. A subtractive process such as a photolithography-etch process may be used to pattern the continuous layer, forming the first discontinuous layer 304.

Figure 4:
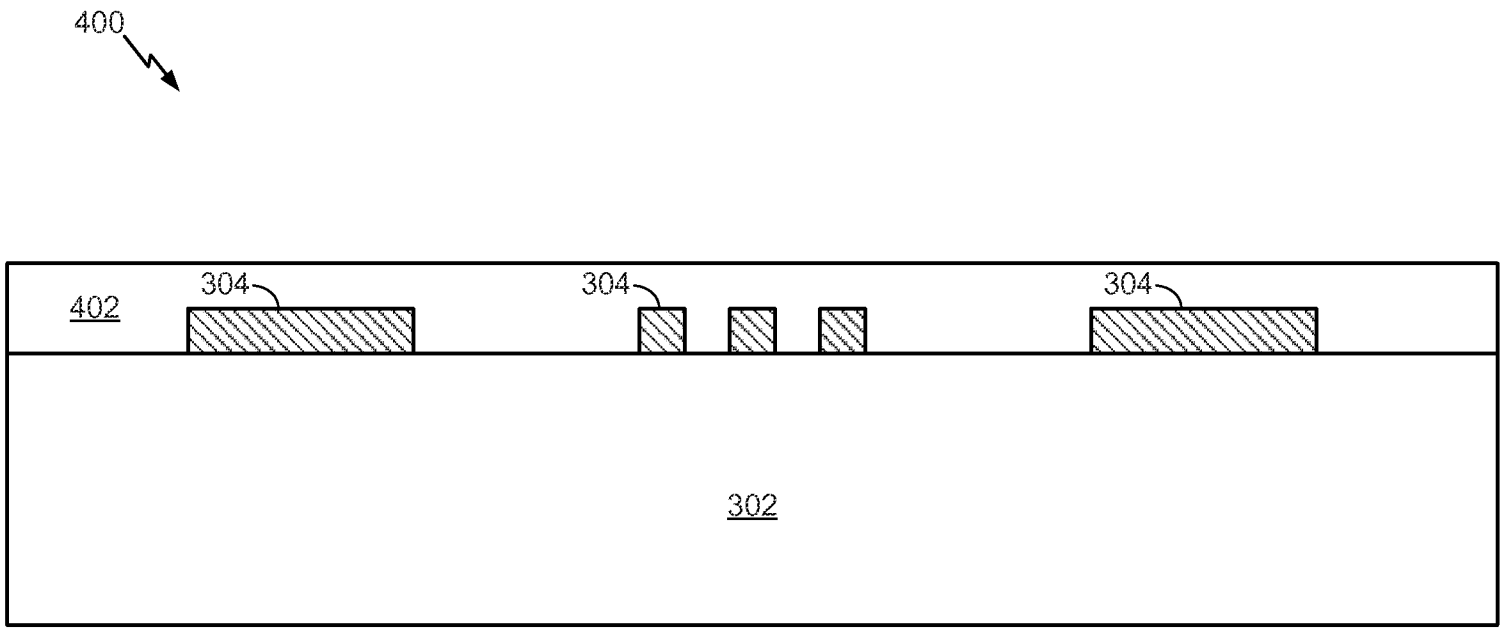
FIG. 4 is a diagram showing a side view of a second illustrative embodiment of a structure during at least one stage in a process of fabricating an electronic device.

Referring to FIG. 4, a second illustrative diagram of a side view of a portion of a structure as formed during at least one stage in a process of fabricating an electronic device is depicted and generally designated 400. In FIG. 4, after the dielectric substrate 302 and the first discontinuous layer 304 are formed, a first passivation layer 402 is formed above the dielectric substrate 302 and the first discontinuous layer 304 to insulate the dielectric substrate 302 and the first discontinuous layer 304 from subsequently formed layers. The first passivation layer 402 may be composed of a dielectric insulator material, such as silicon dioxide ($SiO_2$), silicon nitride ($Si_3N_4$), aluminum oxide ($Al_2O_3$), tantalum pentoxide ($Ta_2O_5$) or another material suitable for insulating the dielectric substrate 302 and the first discontinuous layer 304 from subsequently formed layers. The first passivation layer 402 may be formed using a deposition process, such as chemical vapor deposition, atomic layer deposition, vapor phase deposition (e.g., sputtering), or anodization after a vapor phase deposition process.

Referring to FIG. 5, a third illustrative diagram of a side view of a portion of a structure as formed during at least one stage in a process of fabricating an electronic device is depicted and generally designated 500. In FIG. 5, after the first passivation layer 402 is formed, vias (or recesses) 502 are formed in the first passivation layer 402 and in the dielectric substrate 302. The vias (or recesses) 502 may be formed using an anisotropic etch process, a media blast etch process, a laser etch process, a photoimage etch process, or a combination thereof.

Figure 6:
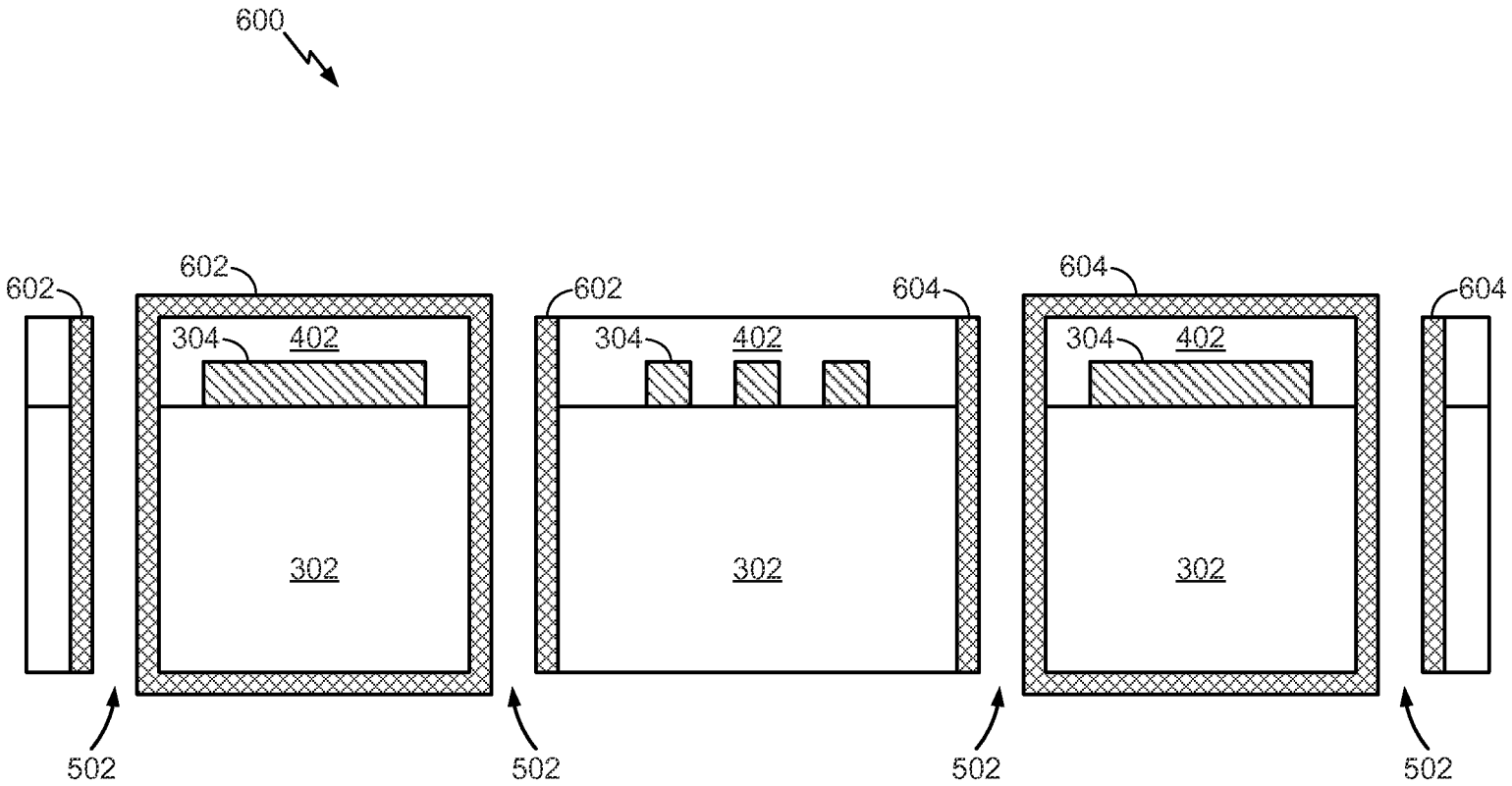
FIG. 6 is a diagram showing a side view of a fourth illustrative embodiment of a structure during at least one stage in a process of fabricating an electronic device.

Referring to FIG. 6, a fourth illustrative diagram of a side view of a portion of a structure as formed during at least one stage in a process of fabricating an electronic device is depicted and generally designated 600. In FIG. 6, after the vias (or recesses) 502 are formed, a seed layer may be deposited on the first passivation layer 402 and the dielectric substrate 302. After the seed layer is deposited, the seed layer may be electroplated to form at least one coil layer (e.g., a first coil layer 602 and/or a second coil layer 604). The at least one coil layer may correspond to the coil 106 of FIG. 1 (e.g., the first coil layer 602 may correspond to a portion of a first loop of the coil 106 and the second coil layer 604 may correspond to a portion of a second loop of the coil 106). The at least one coil layer may be formed of an electrically conductive material.

In a particular embodiment, the dielectric substrate 302 is formed of a glass-type material (e.g., a non-crystalline or amorphous solid material) with a high electrical resistivity and the vias (or recesses) 502 are through glass vias (TGVs) that extend at least partially within the dielectric substrate 302. The at least one coil layer may at least partially fill the vias (or recesses) 502 such that the at least partially filled vias (or recesses) 502 form conductive elements that form a portion of a turn of an inductive device (e.g., a portion of a first turn of the coil 106). More specifically, the at least partially filled vias (or recesses) 502 may form an electrical connection between a first portion 108 of the coil 106 and a second portion 110 of the coil 106.

Figure 7:
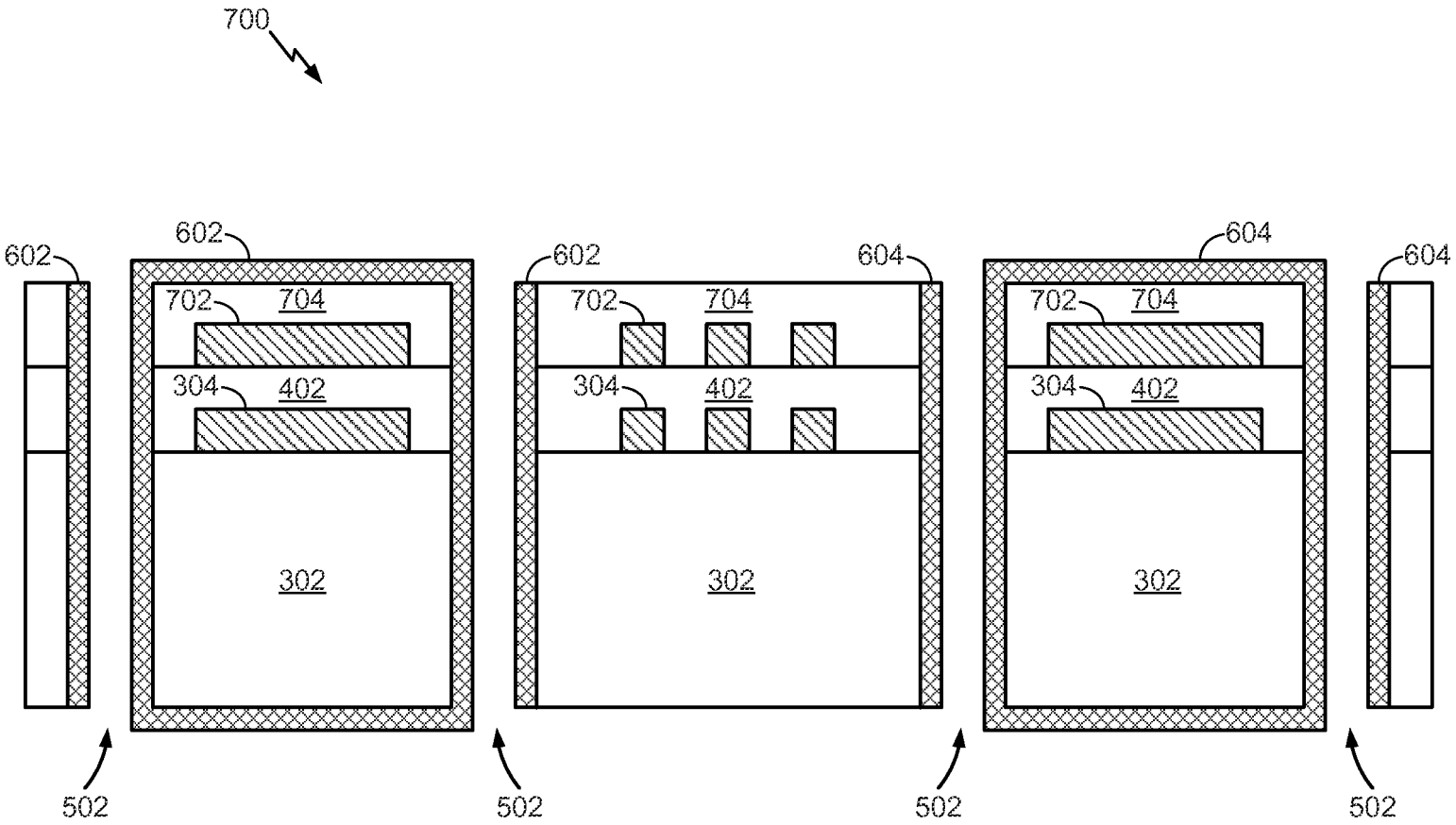
FIG. 7 is a diagram showing a side view of a fifth illustrative embodiment of a structure during at least one stage in a process of fabricating an electronic device.

Referring to FIG. 7, a fifth illustrative diagram of a side view of a portion of a structure as formed during at least one stage in a process of fabricating an electronic device is depicted and generally designated 700. In FIG. 7, after the first passivation layer 402 is formed, a second discontinuous layer 702 and a second passivation layer 704 are formed above the first passivation layer 402. The second discontinuous layer 702 may be deposited above the first surface of the dielectric substrate 302 (and the first passivation layer 402). The second discontinuous layer 702 may form at least a portion of a magnetic core. The magnetic core may correspond to the first magnetic core 102 or the second magnetic core 104 of FIG. 1 or to the magnetic core 200 of FIG. 2.

The second discontinuous layer 702 may be formed using an additive deposition process, such as chemical vapor deposition (CVD), spin-on, sputtering, or electroplating. The second passivation layer 704 may be formed using an additive deposition process, such as chemical vapor deposition (CVD), spin-on, sputtering, or electroplating. The vias (or recesses) 502 and the at least one coil layer (e.g., the first coil layer 602 and/or the second coil layer 604) may be formed after the second passivation layer 704 is formed. Thus, a first magnetic core (e.g., the first magnetic core 102 of FIG. 1) including a first discontinuous layer 304 and a second magnetic core (e.g., the second magnetic core 104 of FIG. 1) including a second discontinuous layer 702 may be formed above a surface of a dielectric substrate 302 and a coil (e.g., the coil 106 of FIG. 1) may be formed with conductive elements (e.g., the first coil layer 602, the second coil layer 604, and the at least partially filled vias (or recesses) 502) that coil around the first magnetic core and the second magnetic core. One or both of the first magnetic core and the second magnetic core may include a plurality of physically separated segments.

Figure 8:
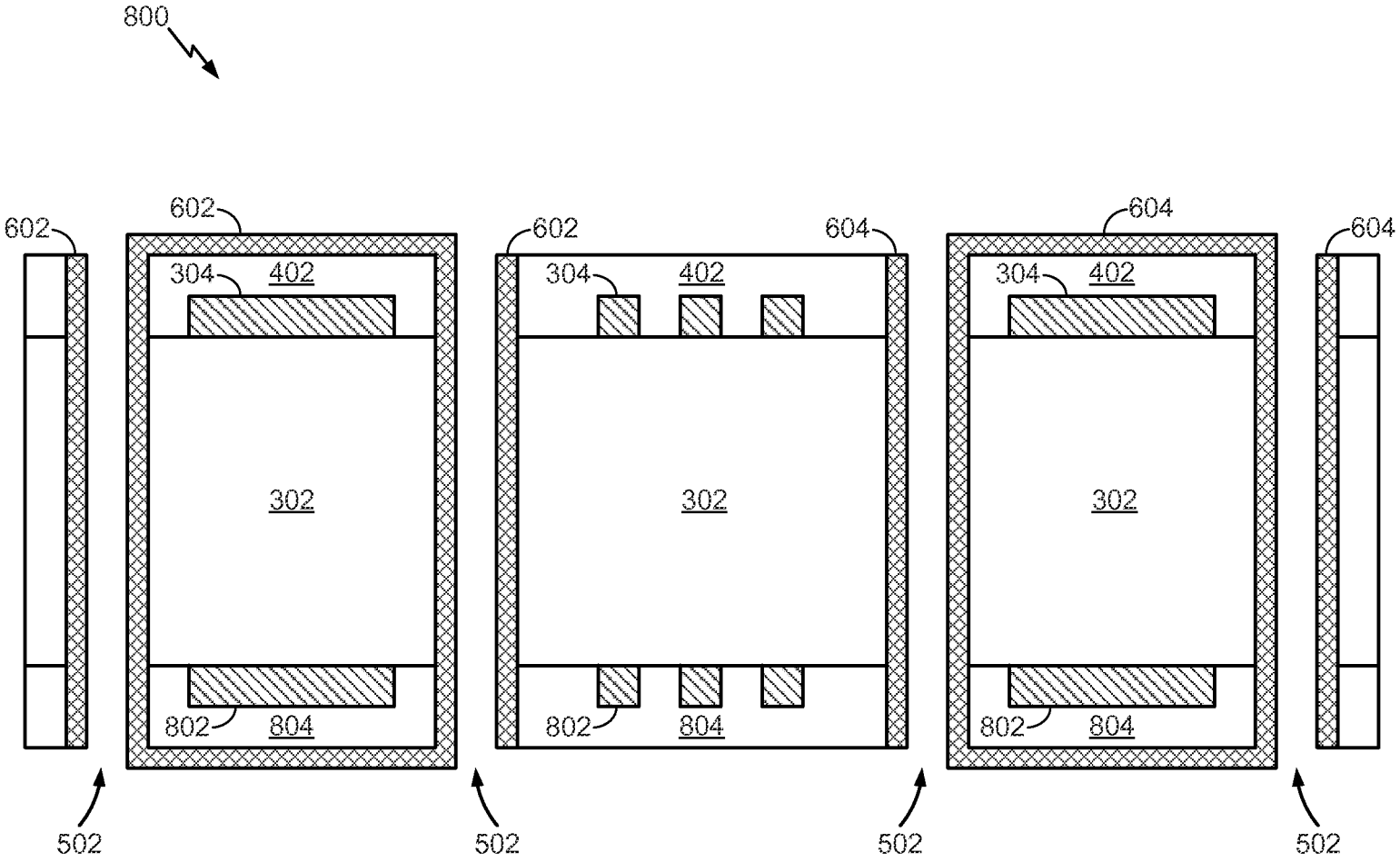
FIG. 8 is a diagram showing a side view of a sixth illustrative embodiment of a structure during at least one stage in a process of fabricating an electronic device.

Referring to FIG. 8, a sixth illustrative diagram of a side view of a portion of a structure as formed during at least one stage in a process of fabricating an electronic device is depicted and generally designated 800. In FIG. 8, a second discontinuous layer 802 and a second passivation layer 804 are formed below (e.g., in the orientation depicted in FIG. 8) the dielectric substrate 302, such that the second discontinuous layer 802 and the second passivation layer 804 are opposite the first discontinuous layer 304 and the first passivation layer 402 across the dielectric substrate 302. The second discontinuous layer 802 may form a magnetic core that may correspond to the first magnetic core 102 or the second magnetic core 104 of FIG. 1 or to the magnetic core 200 of FIG. 2. The second discontinuous layer 802 and the second passivation layer 804 may be formed before the first discontinuous layer 304 and the first passivation layer 402 are formed, during formation of the first discontinuous layer 304 and the first passivation layer 402, or after formation of the first discontinuous layer 304 and the first passivation layer 402. The second discontinuous layer 802 may be formed using an additive film deposition process, such as chemical vapor deposition (CVD), spin-on, sputtering, or electroplating. The second passivation layer 804 may be formed using an additive film deposition process, such as chemical vapor deposition (CVD), spin-on, sputtering, or electroplating. The vias (or recesses) 502 and the at least one coil layer (e.g., the first coil layer 602 and/or the second coil layer 604) may be formed after the first passivation layer 402 and the second passivation layer 804 are formed. Thus, a first magnetic core (e.g., the first magnetic core 102 of FIG. 1) including the first discontinuous layer 304 may be formed above a first surface of the dielectric substrate 302 and a second magnetic core (e.g., the second magnetic core 104 of FIG. 1) including a second discontinuous layer 802 may be formed below a second surface of the dielectric substrate 302 and a coil (e.g., the coil 106 of FIG. 1) may be formed with conductive elements (e.g., the first coil layer 602, the second coil layer 604, and at least partially the filled vias (or recesses) 502) that coil around the first magnetic core and the second magnetic core. One or both of the first magnetic core and the second magnetic core may include a plurality of physically separated segments. The second magnetic core may be substantially symmetrical to the first magnetic core across the dielectric substrate 302.

Figure 9:
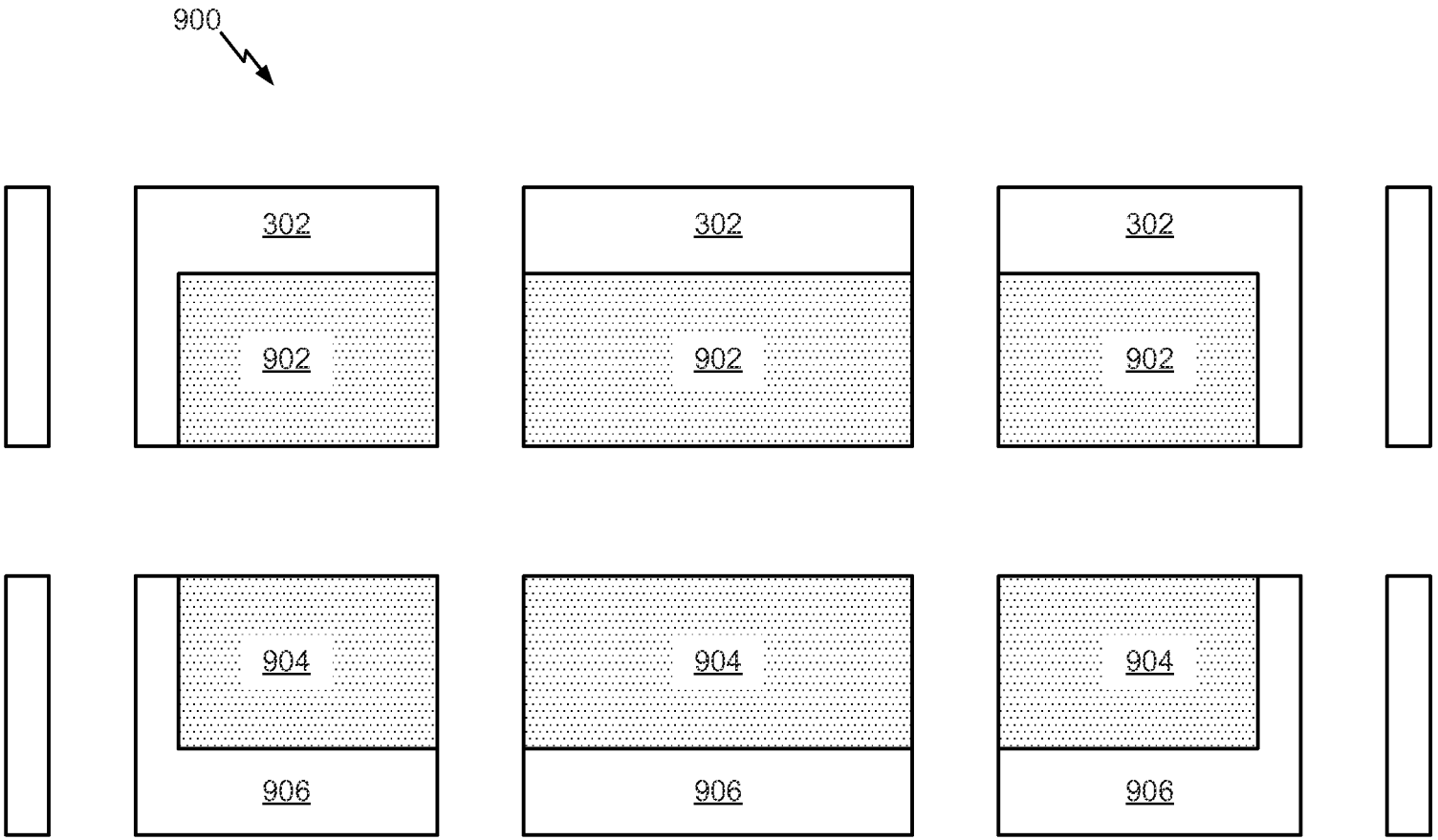
FIG. 9 is a diagram showing a side view of a seventh illustrative embodiment of a structure during at least one stage in a process of fabricating an electronic device.

Referring to FIG. 9, a seventh illustrative diagram of a side view of a portion of a structure as formed during at least one stage in a process of fabricating an electronic device is depicted and generally designated 900. In FIG. 9, a first cavity 902 is formed in the dielectric substrate 302. The first cavity 902 may be formed using an anisotropic etch process, a media blast etch process, a laser etch process, a photoimage etch process, or a combination thereof. The first cavity 902 may be filled with air, a dielectric material with a high electrical resistivity (e.g., an alkaline earth boro-aluminosilicate glass, a glass-based laminate (e.g., a high frequency laminate available from the Rogers corporation), sapphire ($Al_2O_3$), quartz, or a ceramic), or a combination thereof. Although FIG. 9 illustrates a dielectric substrate 302 including a single cavity (e.g., the first cavity 902) with vias (or recesses) formed therein, the dielectric substrate 302 may include more than one cavity. In a particular embodiment, the first cavity 902 has a racetrack toroid shape. A second dielectric substrate 906 may be formed using a fabrication process similar to the fabrication process used to form the dielectric substrate 302. A second cavity 904 may be formed in the second dielectric substrate 906 and may be filled with a similar material to the first cavity 902 or with a different material from the first cavity 902. Once the first cavity 902 and the second cavity 904 are formed, a discontinuous layer corresponding to a magnetic core may be formed in a particular location (e.g., above and/or below a combined substrate formed the dielectric substrate 302 and the second dielectric substrate 906 as in FIG. 10 or inside the first cavity 902, the second cavity 904, or both).

Figure 10:
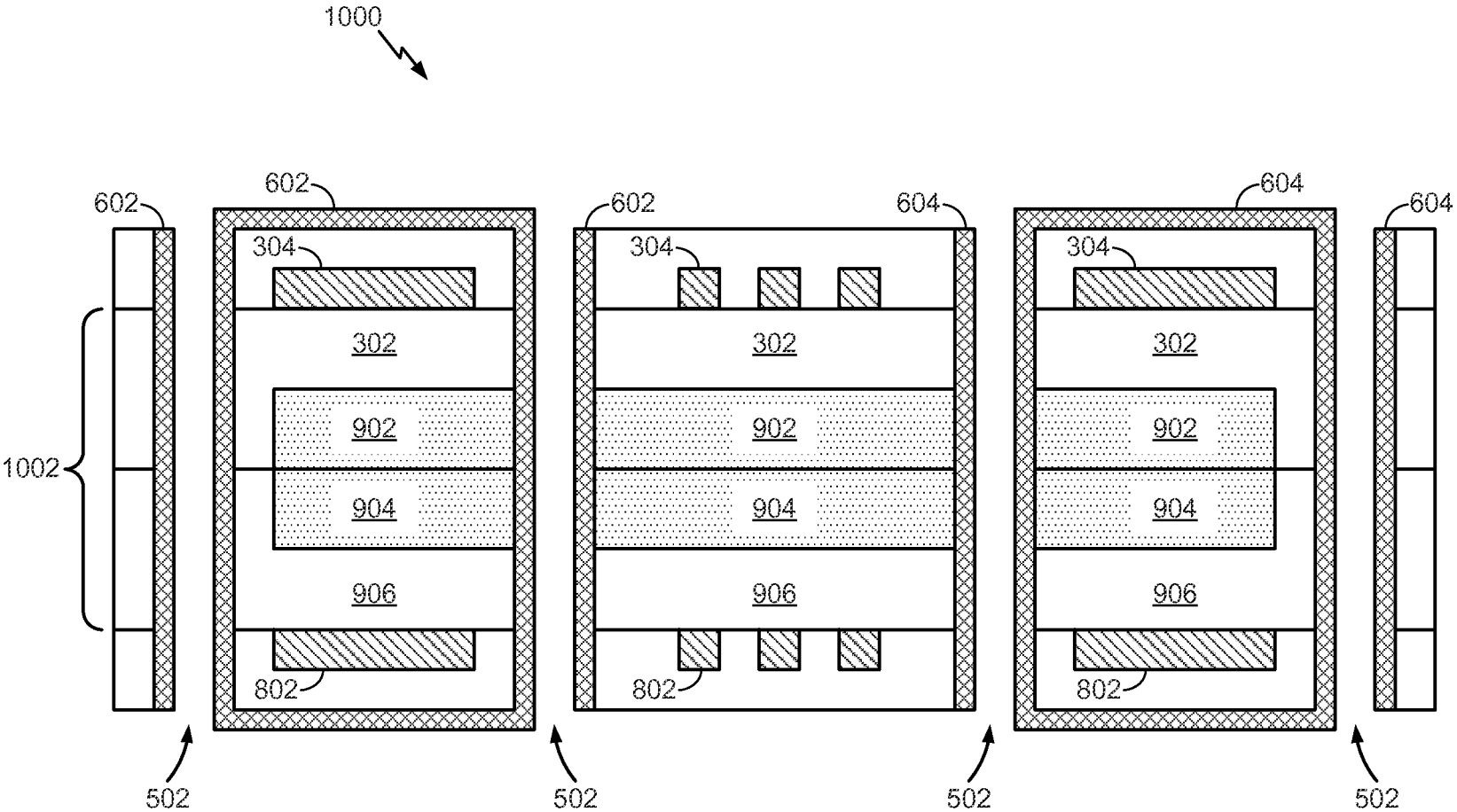
FIG. 10 is a diagram showing a side view of an eighth illustrative embodiment of a structure during at least one stage in a process of fabricating an electronic device.

Referring to FIG. 10, an eighth illustrative diagram of a side view of a portion of a structure as formed during at least one stage in a process of fabricating an electronic device is depicted and generally designated 1000. In FIG. 10, after the first cavity 902 and the second cavity 904 are formed, the dielectric substrate 302 and the second dielectric substrate 906 may be coupled together (e.g., using an adhesive or a thermal bonding process) to form a combined substrate 1002 that encloses the first cavity 902 and the second cavity 904. The first cavity 902 may be substantially aligned with the second cavity 904. When the dielectric substrate 302 and the second dielectric substrate 906 each include multiple cavities, the multiple cavities of the dielectric substrate 302 may be substantially aligned with the multiple cavities of the second dielectric substrate 906. The first cavity 902 and the second cavity 904 may decrease a parasitic capacitance. Decreasing a parasitic capacitance may increase a self-resonant frequency of an inductor (e.g., the inductor 100 of FIG. 1) and decrease a dielectric loss associated with the combined substrate 1002. The combined substrate 1002 may be substituted for the dielectric substrate 302 in the structures described above regarding FIGS. 4-8. For example, a first magnetic core (e.g., the first magnetic core 102 of FIG. 1 or the magnetic core 200 of FIG. 2) including the first discontinuous layer 304 may be formed above a first surface of the combined substrate 1002 and a second magnetic core (e.g., the second magnetic core 104 of FIG. 1) including a second discontinuous layer 802 may be formed below a second surface of the combined substrate 1002 and a coil (e.g., the coil 106 of FIG. 1) may be formed with conductive elements (e.g., the first coil layer 602, the second coil layer 604, and the at least partially filled vias (or recesses) 502) that coil around the first magnetic core and the second magnetic core. One or both of the first magnetic core and the second magnetic core may include a plurality of physically separated segments. The second magnetic core may be substantially symmetrical to the first magnetic core across the combined substrate 1002.

Figure 11:
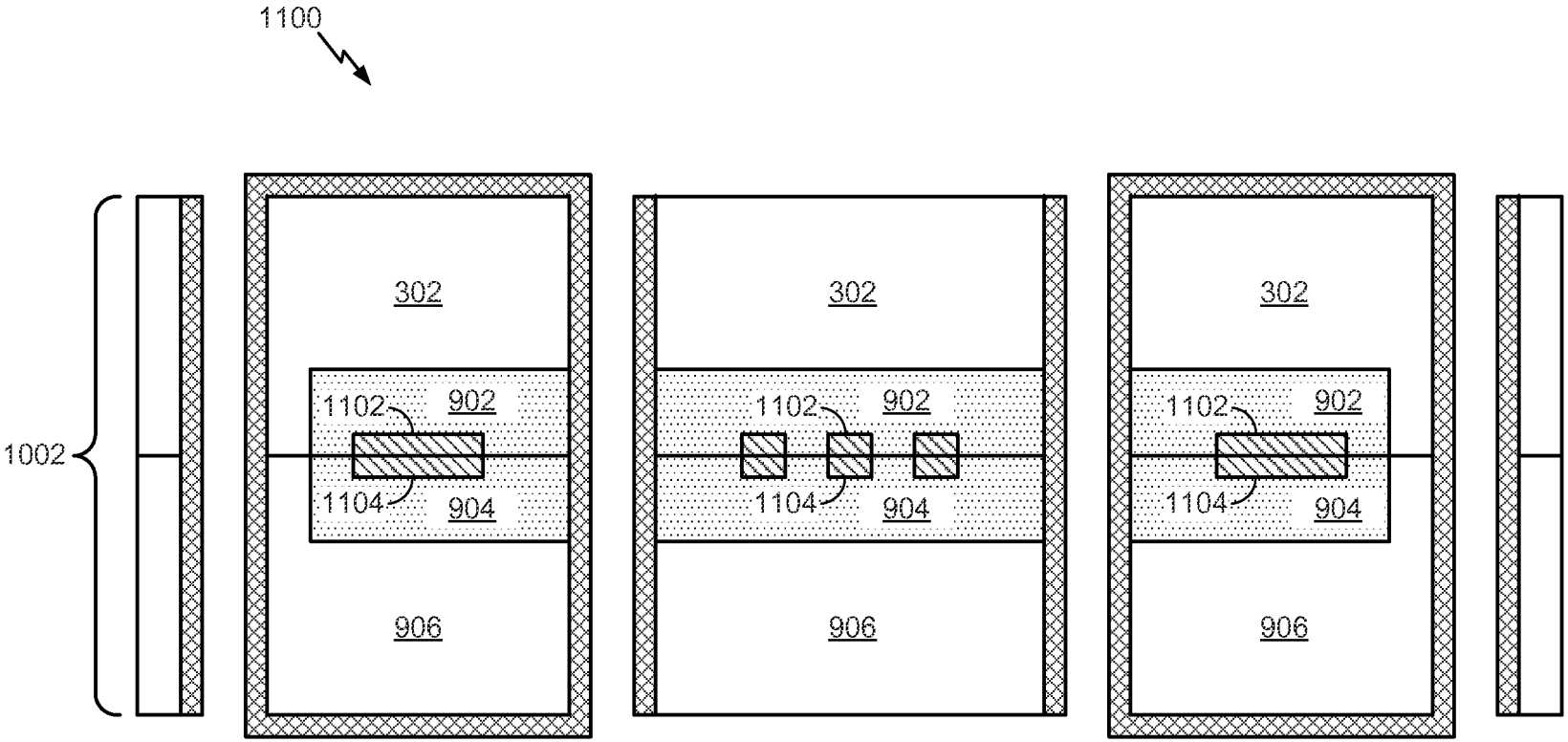
FIG. 11 is a diagram showing a side view of a ninth illustrative embodiment of a structure during at least one stage in a process of fabricating an electronic device.

Referring to FIG. 11, a ninth illustrative diagram of a side view of a portion of a structure as formed during at least one stage in a process of fabricating an electronic device is depicted and generally designated 1100. In FIG. 11, after the first cavity 902 is formed in the dielectric substrate 302, a first interior discontinuous layer 1102 may be formed inside the first cavity 902. The first interior discontinuous layer 1102 may be formed instead of the first discontinuous layer 304 of FIG. 3 or in addition to forming the first discontinuous layer 304. The first interior discontinuous layer 1102 may form a magnetic core that corresponds to the first magnetic core 102 or the second magnetic core 104 of FIG. 1 or to the magnetic core 200 of FIG. 2. The first interior discontinuous layer 1102 may be formed using an additive film deposition process, such as chemical vapor deposition (CVD), spin-on, sputtering, or electroplating. After the second cavity 904 is formed in the second dielectric substrate 906, a second interior discontinuous layer 1104 may be formed inside the second cavity 904. The dielectric substrate 302 and the second dielectric substrate 906 may be coupled together (e.g., using an adhesive) to form a combined substrate 1002 that encloses the first cavity 902 and the second cavity 904. The first cavity 902 may be substantially aligned with the second cavity 904 and the first interior discontinuous layer 1102 may be substantially aligned with the second interior discontinuous layer 1104. Alternatively, an interior discontinuous layer (e.g., the first interior discontinuous layer 1102 or the second interior discontinuous layer 1104) may not be formed in either the first cavity 902 or the second cavity 904. Thus, a first magnetic core (e.g., the first magnetic core 102 of FIG. 1 or the magnetic core 200 of FIG. 2) including a first interior discontinuous layer 1102 may be disposed above a surface of a second dielectric substrate 906 and disposed within a combined substrate 1002. The first magnetic core may include a plurality of physically separated segments.

An electronic device fabricated using the processes shown in FIGS. 3-11 may include an inductor configured to produce a higher effective inductance when the inductor conducts a current (e.g., an alternating current) having a frequency higher than an easy axis roll-off frequency associated with at least one magnetic core, as compared to an electronic device that includes an inductor but does not include the at least one magnetic core, or as compared to an electronic device that includes an inductor and a uniaxial magnetic core that is continuous.

Figure 12:
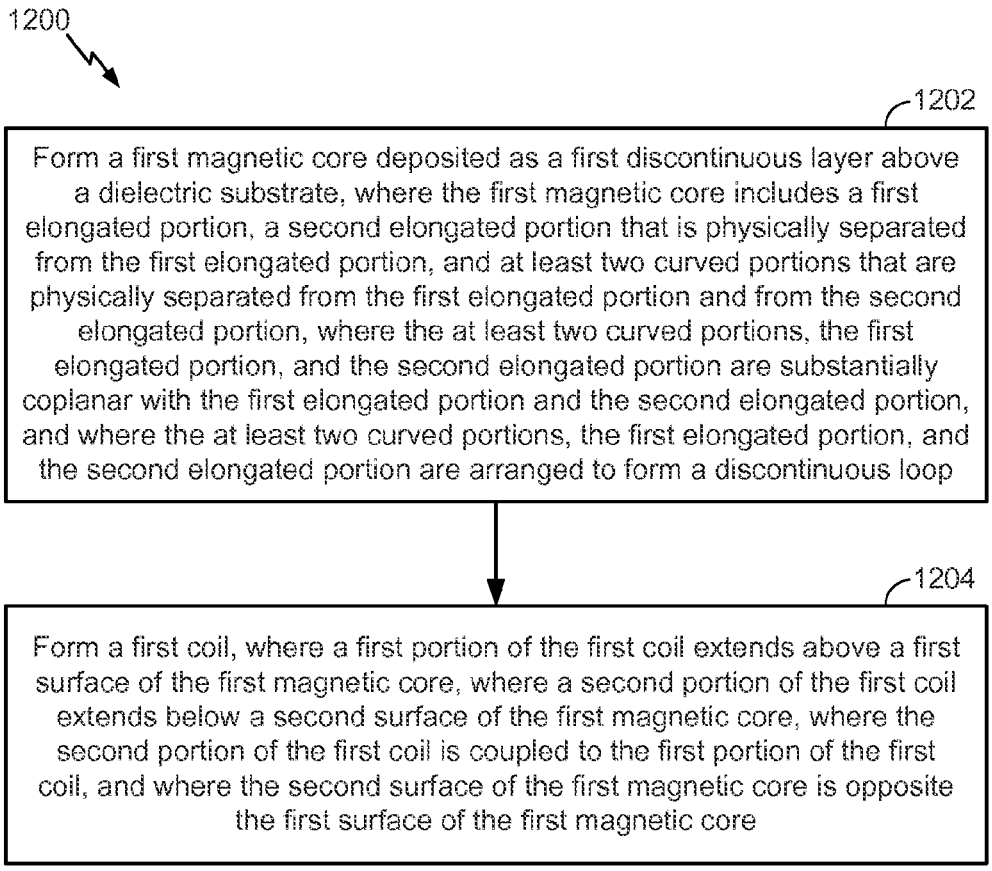
FIG. 12 is a flow chart of a first illustrative embodiment of a method of forming a magnetic core and a coil.

FIG. 12 is a flowchart illustrating a first embodiment of a method 1200 of forming an electronic device. The method includes, at 1202, forming a first magnetic core deposited as a first discontinuous layer above a dielectric substrate, where the first magnetic core includes a first elongated portion, a second elongated portion that is physically separated from the first elongated portion, and at least two curved portions that are physically separated from the first elongated portion and from the second elongated portion, where the at least two curved portions are substantially coplanar with the first elongated portion and the second elongated portion, and where the at least two curved portions, the first elongated portion, and the second elongated portion are arranged to form a discontinuous loop. For example, as described with reference to FIGS. 1 and 2, where the magnetic core 200 corresponds to the first magnetic core 102 or to the second magnetic core 104, the magnetic core 200 may be formed. The magnetic core 200 may be deposited as a discontinuous layer above a dielectric substrate. The magnetic core 200 may include the first elongated portion 202, the second elongated portion 204 that is physically separated from the first elongated portion 202, and at least two curved portions (e.g., the first curved portion 206 and the second curved portion 208) that are physically separated from the first elongated portion 202 and the second elongated portion 204. The at least two curved portions may be substantially coplanar with the first elongated portion 202 and the second elongated portion 204. The at least two curved portions, the first elongated portion 202, and the second elongated portion 204 may be arranged to form a discontinuous loop.

The method 1200 further includes, at 1204, forming a first coil, where a first portion of the first coil extends above a first surface of the first magnetic core, where a second portion of the first coil extends below a second surface of the first magnetic core, and where the second surface of the first magnetic core is opposite the first surface of the first magnetic core. For example, the coil 106 of FIG. 1 may be formed. A first portion 108 of the coil 106 may extend above a first surface of the magnetic core (e.g., the first magnetic core 102 or the second magnetic core 104). A second portion 110 of the coil 106 may extend below a second surface of the magnetic core. The second surface of the magnetic core may be opposite the first surface of the magnetic core. For example, conductive elements (e.g., the first coil layer 602, the second coil layer 604, and the at least partially filled vias (or recesses) 502 of FIG. 6) of the coil 106 may coil around the first magnetic core 102 and around the second magnetic core 104.

The method of FIG. 12 may be initiated by a field-programmable gate array (FPGA) device, an application-specific integrated circuit (ASIC), a processing unit such as a central processing unit (CPU), a digital signal processor (DSP), a controller, another hardware device, firmware device, or any combination thereof. As an example, the method of FIG. 12 can be initiated by fabrication equipment, such as a processor that executes instructions stored at a memory (e.g., a non-transitory computer-readable medium), as described further with reference to FIG. 15.

An electronic device formed according to the method 1200 may include an inductor configured to produce a higher effective inductance when the inductor conducts a current (e.g., an alternating current) having a frequency higher than an easy axis roll-off frequency associated with at least one magnetic core, as compared to an electronic device that includes an inductor but does not include the at least one magnetic core, or as compared to an electronic device that includes an inductor and a uniaxial magnetic core that is continuous.

Figure 13:
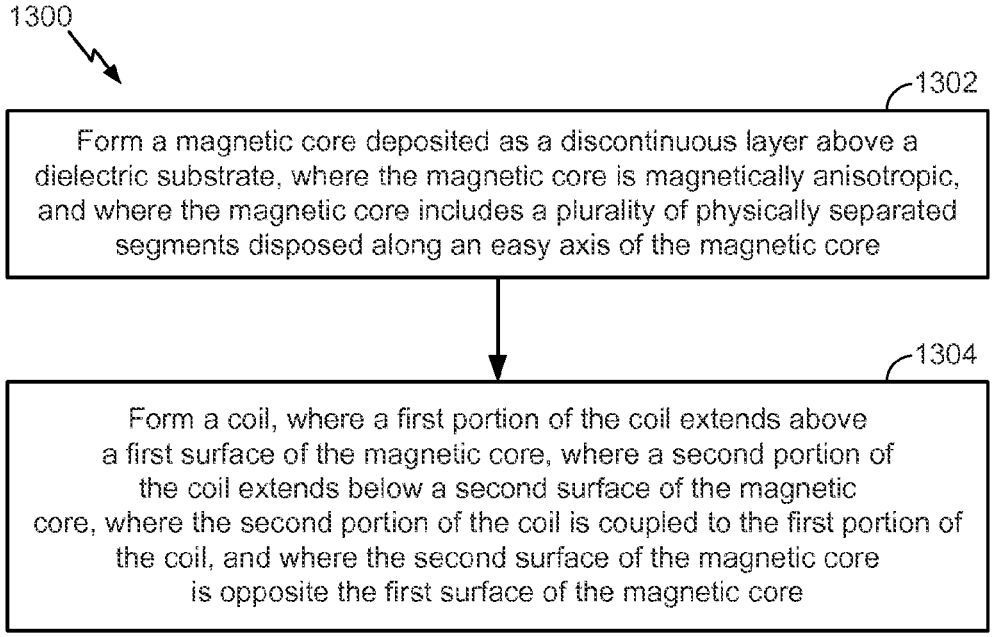
FIG. 13 is a flow chart of a second illustrative embodiment of a method of forming a magnetic core and a coil.

FIG. 13 is a flowchart illustrating a second embodiment of a method 1300 of forming an electronic device. The method includes, at 1302, forming a magnetic core deposited as a discontinuous layer above a dielectric substrate, where the magnetic core is magnetically anisotropic, and where the magnetic core includes a plurality of physically separated segments disposed along an easy axis of the magnetic core. For example, as described with reference to FIGS. 1 and 2, where the magnetic core 200 corresponds to the first magnetic core 102 or to the second magnetic core 104, the magnetic core 200 may be formed. The magnetic core 200 may be deposited as a discontinuous layer above a dielectric substrate. The magnetic core 200 may be magnetically anisotropic. The magnetic core 200 may include a plurality of physically separated segments (e.g., the first elongated portion 202, the second elongated portion 204, the first curved portion 206, and/or the second curved portion 208) disposed along an easy axis of the magnetic core 200.

The method 1300 further includes, at 1304, forming a first coil, where a first portion of the first coil extends above a first surface of the first magnetic core, where a second portion of the first coil extends below a second surface of the first magnetic core, and where the second surface of the first magnetic core is opposite the first surface of the first magnetic core. For example, the coil 106 of FIG. 1 may be formed. A first portion 108 of the coil 106 may extend above a first surface of the magnetic core (e.g., the first magnetic core 102 or the second magnetic core 104). A second portion 110 of the coil 106 may extend below a second surface of the magnetic core. The second surface of the magnetic core may be opposite the first surface of the magnetic core. For example, conductive elements (e.g., the first coil layer 602, the second coil layer 604, and the at least partially filled vias (or recesses) 502 of FIG. 6) of the coil 106 may coil around the first magnetic core 102.

The method of FIG. 13 may be initiated by a field-programmable gate array (FPGA) device, an application-specific integrated circuit (ASIC), a processing unit such as a central processing unit (CPU), a digital signal processor (DSP), a controller, another hardware device, firmware device, or any combination thereof. As an example, the method of FIG. 13 can be initiated by electronic device fabrication equipment, such as a processor that executes instructions stored at a memory (e.g., a non-transitory computer-readable medium), as described further with reference to FIG. 15.

An electronic device formed according to the method 1300 may include an inductor configured to produce a higher effective inductance when the inductor conducts a current (e.g., an alternating current) having a frequency higher than an easy axis roll-off frequency associated with at least one magnetic core, as compared to an electronic device that includes an inductor but does not include the at least one magnetic core, or as compared to an electronic device that includes an inductor and a uniaxial magnetic core that is continuous.

Figure 14:
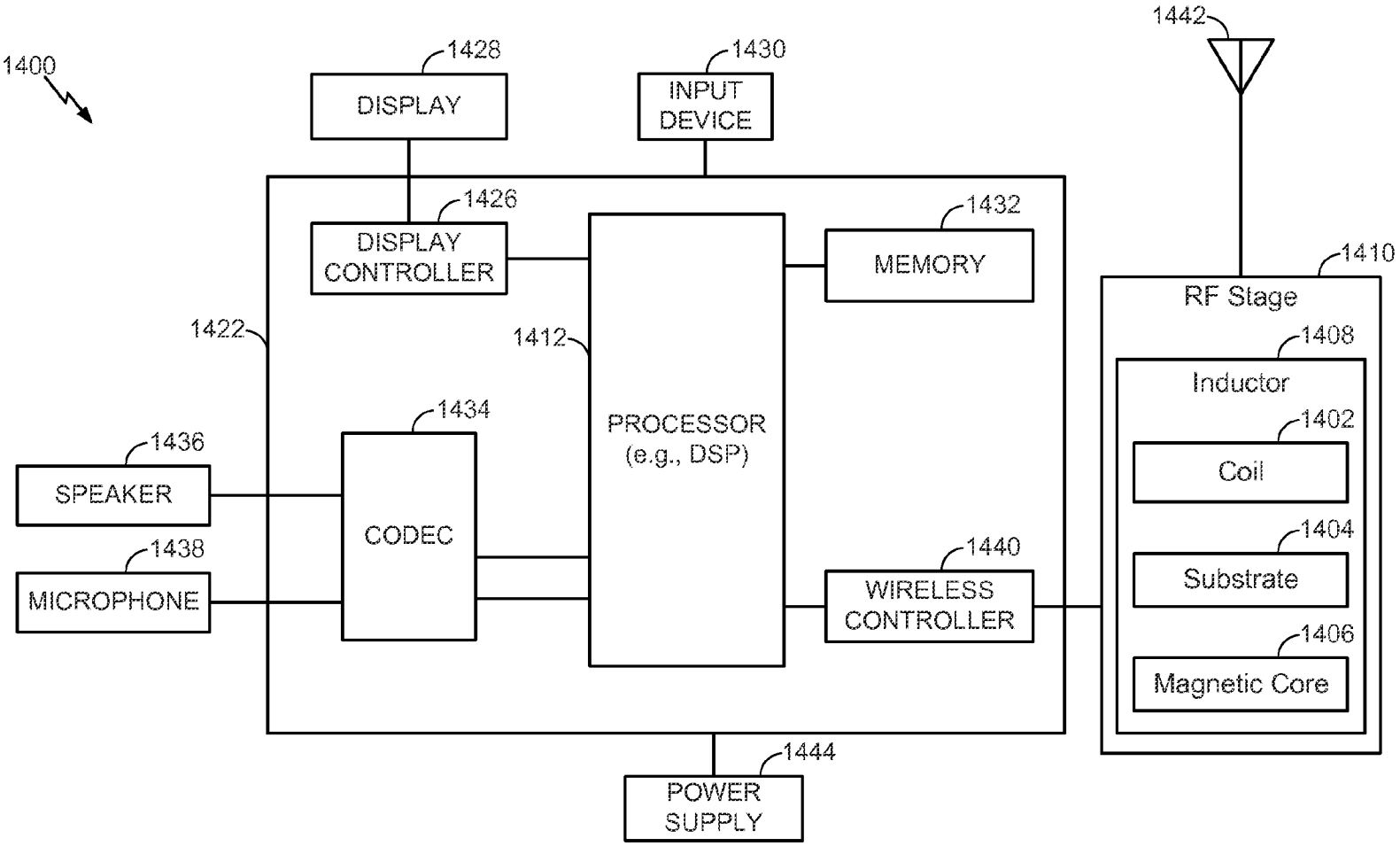
FIG. 14 is a block diagram of a communication device including an inductor that includes a coil, a substrate, and a magnetic core.

Referring to FIG. 14, a block diagram of a particular illustrative embodiment of a mobile device that includes a coil 1402, a substrate 1404, and a magnetic core 1406 is depicted and generally designated 1400. The mobile device 1400, or components thereof, may include, implement, or be included within a device such as: a mobile station, an access point, a set top box, an entertainment unit, a navigation device, a communications device, a personal digital assistant (PDA), a fixed location data unit, a mobile location data unit, a mobile phone, a cellular phone, a computer, a portable computer, a desktop computer, a tablet, a monitor, a computer monitor, a television, a tuner, a radio, a satellite radio, a music player, a digital music player, a portable music player, a video player, a digital video player, a digital video disc (DVD) player, or a portable digital video player.

The mobile device 1400 may include a processor 1412, such as a digital signal processor (DSP). The processor 1412 may be coupled to a memory 1432 (e.g., a non-transitory computer-readable medium).

FIG. 14 also shows a display controller 1426 that is coupled to the processor 1412 and to a display 1428. A coder/decoder (CODEC) 1434 can also be coupled to the processor 1412. A speaker 1436 and a microphone 1438 can be coupled to the CODEC 1434. A wireless controller 1440 can be coupled to the processor 1412 and can be further coupled to an RF stage 1410 that includes an inductor 1408 that includes the coil 1402, the substrate 1404, and the magnetic core 1406. The RF stage 1410 may be coupled to an antenna 1442. The magnetic core 1406 may be deposited as a discontinuous layer above the substrate 1404. Conductive elements of the coil 1402 may coil around the magnetic core 1406. The inductor 1408 may produce a higher effective inductance when the coil 1402 conducts a current (e.g., an alternating current) having a frequency higher than an easy axis roll-off frequency associated with the magnetic core 1406, as compared to an electronic device that includes an inductor but does not include the magnetic core 1406, or as compared to an electronic device that includes an inductor and where conductive elements of the coil 1402 are coiled around a continuous uniaxial magnetic core. The coil 1402 may correspond to the coil 106 of FIG. 1 or the coil formed by the first coil layer 602 or the second coil layer 604 of FIG. 6. The substrate 1404 may correspond to the dielectric substrate 302 of FIG. 3 or the combined substrate 1002 of FIG. 10. The magnetic core 1406 may correspond to the first magnetic core 102 or the second magnetic core 104 of FIG. 1, to the magnetic core 200 of FIG. 2, to the magnetic core formed by the first discontinuous layer 304 of FIG. 3, to the magnetic core formed by the second discontinuous layer 702 of FIG. 7, to the magnetic core formed by the second discontinuous layer 802 of FIG. 8, or to the magnetic core formed by the first interior discontinuous layer 1102, the second interior discontinuous layer 1104, or both, of FIG. 11. In other embodiments, the coil 1402, the substrate 1404, and the magnetic core 1406 may be included in, or configured to provide inductance to, other components of the mobile device 1400.

In a particular embodiment, the processor 1412, the display controller 1426, the memory 1432, the CODEC 1434, and the wireless controller 1440 are included in a system-in-package or system-on-chip device 1422. An input device 1430 and a power supply 1444 may be coupled to the system-on-chip device 1422. Moreover, in a particular embodiment, and as illustrated in FIG. 14, the RF stage 1410, the display 1428, the input device 1430, the speaker 1436, the microphone 1438, the antenna 1442, and the power supply 1444 are external to the system-on-chip device 1422. However, each of the display 1428, the input device 1430, the speaker 1436, the microphone 1438, the antenna 1442, and the power supply 1444 can be coupled to a component of the system-on-chip device 1422, such as an interface or a controller. The RF stage 1410 may be included in the system-on-chip device 1422 or may be a separate component.

In conjunction with the described embodiments, a device (such as the mobile device 1400) may include means for inducing a magnetic field. The device may further include means for guiding the magnetic field. The means for guiding the magnetic field may include a first elongated portion. The means for guiding the magnetic field may further include a second elongated portion that is physically separated from the first elongated portion. The means for guiding the magnetic field may further include at least two curved portions that are physically separated from the first elongated portion and from the second elongated portion. The at least two curved portions may be substantially coplanar with the first elongated portion and the second elongated portion. The at least two curved portions, the first elongated portion, and the second elongated portion may be arranged to form a discontinuous loop. The device may further include means for supporting layers. The means for guiding the magnetic field may be deposited as a discontinuous layer above the means for supporting layers. A first portion of the means for inducing the magnetic field may extend above a first surface of the means for guiding the magnetic field. A second portion of the means for inducing the magnetic field may extend below a second surface of the means for guiding the magnetic field. The second surface of the means for guiding the magnetic field may be opposite the first surface of the means for guiding the magnetic field. The means for inducing the magnetic field may include or correspond to the coil 106 of FIG. 1 or the coil formed by the first coil layer 602 or the second coil layer 604 of FIG. 6. The means for guiding the magnetic field may include or correspond to the first magnetic core 102 or the second magnetic core 104 of FIG. 1, the magnetic core 200 of FIG. 2, the magnetic core formed by the first discontinuous layer 304 of FIG. 3, the magnetic core formed by the second discontinuous layer 702 of FIG. 7, the magnetic core formed by the second discontinuous layer 802 of FIG. 8, or the magnetic core formed by the first interior discontinuous layer 1102, the second interior discontinuous layer 1104, or both, of FIG. 11. The means for supporting layers may include or correspond to the dielectric substrate 302 of FIG. 3 or the combined substrate 1002 of FIG. 10.

In conjunction with the described embodiments, a device (such as the mobile device 1400) may include means for inducing a magnetic field. The device may further include means for guiding the magnetic field. The means for guiding the magnetic field may be magnetically anisotropic. The means for guiding the magnetic field may include a plurality of physically separated segments disposed along an easy axis of the means for guiding the magnetic field. The device may further include means for supporting layers. The means for guiding the magnetic field may be deposited as a discontinuous layer above the means for supporting layers. A first portion of the means inducing the magnetic field may extend above a first surface of the means for guiding the magnetic field. A second portion of the means for inducing the magnetic field may extend below a second surface of the means for guiding the magnetic field. The second surface of the means for guiding the magnetic field may be opposite the first surface of the means for guiding the magnetic field. The means for inducing the magnetic field may include or correspond to the coil 106 of FIG. 1 or the coil formed by the first coil layer 602 or the second coil layer 604 of FIG. 6. The means for guiding the magnetic field may include or correspond to the first magnetic core 102 or the second magnetic core 104 of FIG. 1, the magnetic core 200 of FIG. 2, the magnetic core formed by the first discontinuous layer 304 of FIG. 3, the magnetic core formed by the second discontinuous layer 702 of FIG. 7, the magnetic core formed by the second discontinuous layer 802 of FIG. 8, or the magnetic core formed by the first interior discontinuous layer 1102, the second interior discontinuous layer 1104, or both, of FIG. 11. The means for supporting layers may include or correspond to the dielectric substrate 302 of FIG. 3 or the combined substrate 1002 of FIG. 10.

The foregoing disclosed devices and functionalities may be designed and configured into computer files (e.g. RTL, GDSII, GERBER, etc.) stored on computer-readable media. Some or all such files may be provided to fabrication handlers to fabricate devices based on such files. Resulting products include wafers that are then cut into dies and packaged into chips. The chips are then integrated into electronic devices, as described further with reference to FIG. 15.

Figure 15:
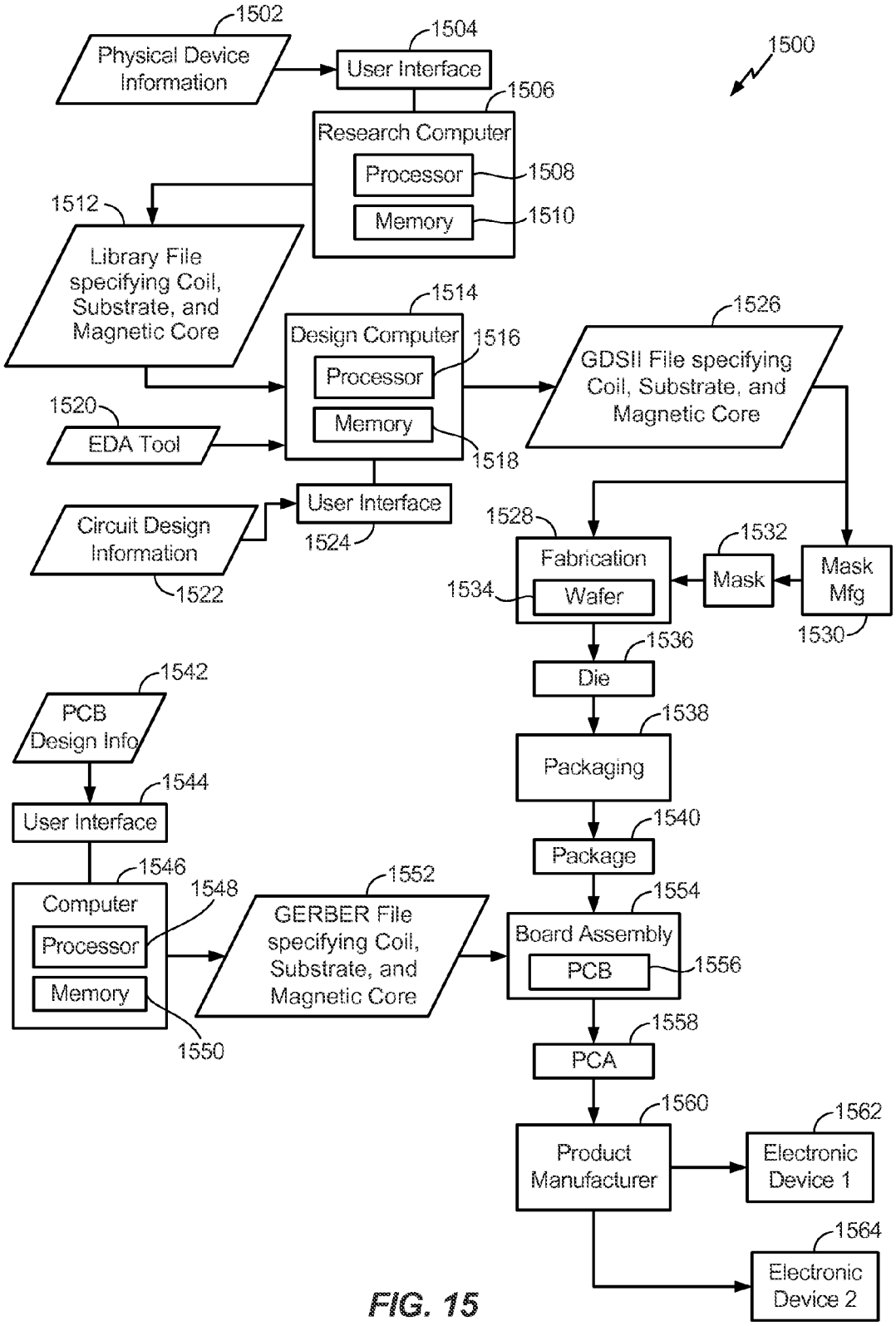
FIG. 15 is a data flow diagram of a particular illustrative embodiment of a manufacturing process to manufacture electronic devices that include a coil, a substrate, and a magnetic core.

Referring to FIG. 15, a particular illustrative embodiment of an electronic device manufacturing process is depicted and generally designated 1500. In FIG. 15, physical device information 1502 is received at the manufacturing process 1500, such as at a research computer 1506. The physical device information 1502 may include design information representing at least one physical property of an electronic device, such as a coil (e.g., corresponding to the coil 106 of FIG. 1 or the coil formed by the first coil layer 602 or the second coil layer 604 of FIG. 6), a substrate (e.g., corresponding to the dielectric substrate 302 of FIG. 3 or the combined substrate 1002 of FIG. 10), and a magnetic core (e.g., corresponding to the first magnetic core 102 or the second magnetic core 104 of FIG. 1, to the magnetic core 200 of FIG. 2, to the magnetic core formed by the first discontinuous layer 304 of FIG. 3, to the magnetic core formed by the second discontinuous layer 702 of FIG. 7, to the magnetic core formed by the second discontinuous layer 802 of FIG. 8, or to the magnetic core formed by the first interior discontinuous layer 1102, the second interior discontinuous layer 1104, or both, of FIG. 11). For example, the physical device information 1502 may include physical parameters, material characteristics, and structure information that is entered via a user interface 1504 coupled to the research computer 1506. The research computer 1506 includes a processor 1508, such as one or more processing cores, coupled to a computer-readable medium such as a memory 1510. The memory 1510 may store computer-readable instructions that are executable to cause the processor 1508 to transform the physical device information 1502 to comply with a file format and to generate a library file 1512.

In a particular embodiment, the library file 1512 includes at least one data file including the transformed design information. For example, the library file 1512 may include a library of electronic devices (e.g., semiconductor devices), including a coil (e.g., corresponding to the coil 106 of FIG. 1 or the coil formed by the first coil layer 602 or the second coil layer 604 of FIG. 6), a substrate (e.g., corresponding to the dielectric substrate 302 of FIG. 3 or the combined substrate 1002 of FIG. 10), and a magnetic core (e.g., corresponding to the first magnetic core 102 or the second magnetic core 104 of FIG. 1, to the magnetic core 200 of FIG. 2, to the magnetic core formed by the first discontinuous layer 304 of FIG. 3, to the magnetic core formed by the second discontinuous layer 702 of FIG. 7, to the magnetic core formed by the second discontinuous layer 802 of FIG. 8, or to the magnetic core formed by the first interior discontinuous layer 1102, the second interior discontinuous layer 1104, or both, of FIG. 11), provided for use with an electronic design automation (EDA) tool 1520.

The library file 1512 may be used in conjunction with the EDA tool 1520 at a design computer 1514 including a processor 1516, such as one or more processing cores, coupled to a memory 1518. The EDA tool 1520 may be stored as processor executable instructions at the memory 1518 to enable a user of the design computer 1514 to design a circuit including a coil (e.g., corresponding to the coil 106 of FIG. 1 or the coil formed by the first coil layer 602 or the second coil layer 604 of FIG. 6), a substrate (e.g., corresponding to the dielectric substrate 302 of FIG. 3 or the combined substrate 1002 of FIG. 10), and a magnetic core (e.g., corresponding to the first magnetic core 102 or the second magnetic core 104 of FIG. 1, to the magnetic core 200 of FIG. 2, to the magnetic core formed by the first discontinuous layer 304 of FIG. 3, to the magnetic core formed by the second discontinuous layer 702 of FIG. 7, to the magnetic core formed by the second discontinuous layer 802 of FIG. 8, or to the magnetic core formed by the first interior discontinuous layer 1102, the second interior discontinuous layer 1104, or both, of FIG. 11), using the library file 1512. For example, a user of the design computer 1514 may enter circuit design information 1522 via a user interface 1524 coupled to the design computer 1514. The circuit design information 1522 may include design information representing at least one physical property of an electronic device, such as a coil (e.g., corresponding to the coil 106 of FIG. 1 or the coil formed by the first coil layer 602 or the second coil layer 604 of FIG. 6), a substrate (e.g., corresponding to the dielectric substrate 302 of FIG. 3 or the combined substrate 1002 of FIG. 10), and a magnetic core (e.g., corresponding to the first magnetic core 102 or the second magnetic core 104 of FIG. 1, to the magnetic core 200 of FIG. 2, to the magnetic core formed by the first discontinuous layer 304 of FIG. 3, to the magnetic core formed by the second discontinuous layer 702 of FIG. 7, to the magnetic core formed by the second discontinuous layer 802 of FIG. 8, or to the magnetic core formed by the first interior discontinuous layer 1102, the second interior discontinuous layer 1104, or both, of FIG. 11). To illustrate, the circuit design property may include identification of particular circuits and relationships to other elements in a circuit design, positioning information, feature size information, interconnection information, or other information representing a physical property of an electronic device.

The design computer 1514 may be configured to transform the design information, including the circuit design information 1522, to comply with a file format. To illustrate, the file formation may include a database binary file format representing planar geometric shapes, text labels, and other information about a circuit layout in a hierarchical format, such as a Graphic Data System (GDSII) file format. The design computer 1514 may be configured to generate a data file including the transformed design information, such as a GDSII file 1526 that includes information describing a coil (e.g., corresponding to the coil 106 of FIG. 1 or the coil formed by the first coil layer 602 or the second coil layer 604 of FIG. 6), a substrate (e.g., corresponding to the dielectric substrate 302 of FIG. 3 or the combined substrate 1002 of FIG. 10), and a magnetic core (e.g., corresponding to the first magnetic core 102 or the second magnetic core 104 of FIG. 1, to the magnetic core 200 of FIG. 2, to the magnetic core formed by the first discontinuous layer 304 of FIG. 3, to the magnetic core formed by the second discontinuous layer 702 of FIG. 7, to the magnetic core formed by the second discontinuous layer 802 of FIG. 8, or to the magnetic core formed by the first interior discontinuous layer 1102, the second interior discontinuous layer 1104, or both, of FIG. 11), in addition to other circuits or information. To illustrate, the data file may include information corresponding to a system-on-chip (SOC) or a chip interposer component that that includes a coil (e.g., corresponding to the coil 106 of FIG. 1 or the coil formed by the first coil layer 602 or the second coil layer 604 of FIG. 6), a substrate (e.g., corresponding to the dielectric substrate 302 of FIG. 3 or the combined substrate 1002 of FIG. 10), and a magnetic core (e.g., corresponding to the first magnetic core 102 or the second magnetic core 104 of FIG. 1, to the magnetic core 200 of FIG. 2, to the magnetic core formed by the first discontinuous layer 304 of FIG. 3, to the magnetic core formed by the second discontinuous layer 702 of FIG. 7, to the magnetic core formed by the second discontinuous layer 802 of FIG. 8, or to the magnetic core formed by the first interior discontinuous layer 1102, the second interior discontinuous layer 1104, or both, of FIG. 11), and that also includes additional electronic circuits and components within the SOC.

The GDSII file 1526 may be received at a fabrication process 1528 to manufacture a coil (e.g., corresponding to the coil 106 of FIG. 1 or the coil formed by the first coil layer 602 or the second coil layer 604 of FIG. 6), a substrate (e.g., corresponding to the dielectric substrate 302 of FIG. 3 or the combined substrate 1002 of FIG. 10), and a magnetic core (e.g., corresponding to the first magnetic core 102 or the second magnetic core 104 of FIG. 1, to the magnetic core 200 of FIG. 2, to the magnetic core formed by the first discontinuous layer 304 of FIG. 3, to the magnetic core formed by the second discontinuous layer 702 of FIG. 7, to the magnetic core formed by the second discontinuous layer 802 of FIG. 8, or to the magnetic core formed by the first interior discontinuous layer 1102, the second interior discontinuous layer 1104, or both, of FIG. 11) according to transformed information in the GDSII file 1526. For example, a device manufacture process may include providing the GDSII file 1526 to a mask manufacturer 1530 to create one or more masks, such as masks to be used with photolithography processing, illustrated in FIG. 15 as a representative mask 1532. The mask 1532 may be used during the fabrication process to generate one or more wafers 1534, which may be tested and separated into dies, such as a representative die 1536. The die 1536 includes a circuit including a coil (e.g., corresponding to the coil 106 of FIG. 1 or the coil formed by the first coil layer 602 or the second coil layer 604 of FIG. 6), a substrate (e.g., corresponding to the dielectric substrate 302 of FIG. 3 or the combined substrate 1002 of FIG. 10), and a magnetic core (e.g., corresponding to the first magnetic core 102 or the second magnetic core 104 of FIG. 1, to the magnetic core 200 of FIG. 2, to the magnetic core formed by the first discontinuous layer 304 of FIG. 3, to the magnetic core formed by the second discontinuous layer 702 of FIG. 7, to the magnetic core formed by the second discontinuous layer 802 of FIG. 8, or to the magnetic core formed by the first interior discontinuous layer 1102, the second interior discontinuous layer 1104, or both, of FIG. 11).

The die 1536 may be provided to a packaging process 1538 where the die 1536 is incorporated into a representative package 1540. For example, the package 1540 may include the single die 1536 or multiple dies, such as a system-in-package (SiP) arrangement. The package 1540 may be configured to conform to one or more standards or specifications, such as Joint Electron Device Engineering Council (JEDEC) standards.

Information regarding the package 1540 may be distributed to various product designers, such as via a component library stored at a computer 1546. The computer 1546 may include a processor 1548, such as one or more processing cores, coupled to a memory 1550. A printed circuit board (PCB) tool may be stored as processor executable instructions at the memory 1550 to process PCB design information 1542 received from a user of the computer 1546 via a user interface 1544. The PCB design information 1542 may include physical positioning information of a packaged electronic device on a circuit board, the packaged electronic device corresponding to the package 1540 including a coil (e.g., corresponding to the coil 106 of FIG. 1 or the coil formed by the first coil layer 602 or the second coil layer 604 of FIG. 6), a substrate (e.g., corresponding to the dielectric substrate 302 of FIG. 3 or the combined substrate 1002 of FIG. 10), and a magnetic core (e.g., corresponding to the first magnetic core 102 or the second magnetic core 104 of FIG. 1, to the magnetic core 200 of FIG. 2, to the magnetic core formed by the first discontinuous layer 304 of FIG. 3, to the magnetic core formed by the second discontinuous layer 702 of FIG. 7, to the magnetic core formed by the second discontinuous layer 802 of FIG. 8, or to the magnetic core formed by the first interior discontinuous layer 1102, the second interior discontinuous layer 1104, or both, of FIG. 11).

The computer 1546 may be configured to transform the PCB design information 1542 to generate a data file, such as a GERBER file 1552 with data that includes physical positioning information of a packaged electronic device on a circuit board, as well as layout of electrical connections such as traces and vias, where the packaged electronic device corresponds to the package 1540 including a coil (e.g., corresponding to the coil 106 of FIG. 1 or the coil formed by the first coil layer 602 or the second coil layer 604 of FIG. 6), a substrate (e.g., corresponding to the dielectric substrate 302 of FIG. 3 or the combined substrate 1002 of FIG. 10), and a magnetic core (e.g., corresponding to the first magnetic core 102 or the second magnetic core 104 of FIG. 1, to the magnetic core 200 of FIG. 2, to the magnetic core formed by the first discontinuous layer 304 of FIG. 3, to the magnetic core formed by the second discontinuous layer 702 of FIG. 7, to the magnetic core formed by the second discontinuous layer 802 of FIG. 8, or to the magnetic core formed by the first interior discontinuous layer 1102, the second interior discontinuous layer 1104, or both, of FIG. 11). In other embodiments, the data file generated by the transformed PCB design information may have a format other than a GERBER format.

The GERBER file 1552 may be received at a board assembly process 1554 and used to create PCBs, such as a representative PCB 1556, manufactured in accordance with the design information stored within the GERBER file 1552. For example, the GERBER file 1552 may be uploaded to one or more machines to perform various steps of a PCB production process. The PCB 1556 may be populated with electronic components including the package 1540 to form a representative printed circuit assembly (PCA) 1558.

The PCA 1558 may be received at a product manufacturer 1560 and integrated into one or more electronic devices, such as a first representative electronic device 1562 and a second representative electronic device 1564. As an illustrative, non-limiting example, the first representative electronic device 1562, the second representative electronic device 1564, or both, may be selected from a set top box, a music player, a video player, an entertainment unit, a navigation device, a communications device, a personal digital assistant (PDA), a fixed location data unit, and a computer, into which a coil (e.g., corresponding to the coil 106 of FIG. 1 or the coil formed by the first coil layer 602 or the second coil layer 604 of FIG. 6), a substrate (e.g., corresponding to the dielectric substrate 302 of FIG. 3 or the combined substrate 1002 of FIG. 10), and a magnetic core (e.g., corresponding to the first magnetic core 102 or the second magnetic core 104 of FIG. 1, to the magnetic core 200 of FIG. 2, to the magnetic core formed by the first discontinuous layer 304 of FIG. 3, to the magnetic core formed by the second discontinuous layer 702 of FIG. 7, to the magnetic core formed by the second discontinuous layer 802 of FIG. 8, or to the magnetic core formed by the first interior discontinuous layer 1102, the second interior discontinuous layer 1104, or both, of FIG. 11), are integrated. As another illustrative, non-limiting example, one or more of the electronic devices 1562 and 1564 may be remote units such as mobile phones, hand-held personal communication systems (PCS) units, portable data units such as personal data assistants, global positioning system (GPS) enabled devices, navigation devices, fixed location data units such as meter reading equipment, or any other device that stores or retrieves data or computer instructions, or any combination thereof. Although FIG. 15 illustrates remote units according to teachings of the disclosure, the disclosure is not limited to these illustrated units. Embodiments of the disclosure may be suitably employed in any device which includes active integrated circuitry including memory and on-chip circuitry.

A device that includes a coil (e.g., corresponding to the coil 106 of FIG. 1 or the coil formed by the first coil layer 602 or the second coil layer 604 of FIG. 6), a substrate (e.g., corresponding to the dielectric substrate 302 of FIG. 3 or the combined substrate 1002 of FIG. 10), and a magnetic core (e.g., corresponding to the first magnetic core 102 or the second magnetic core 104 of FIG. 1, to the magnetic core 200 of FIG. 2, to the magnetic core formed by the first discontinuous layer 304 of FIG. 3, to the magnetic core formed by the second discontinuous layer 702 of FIG. 7, to the magnetic core formed by the second discontinuous layer 802 of FIG. 8, or to the magnetic core formed by the first interior discontinuous layer 1102, the second interior discontinuous layer 1104, or both, of FIG. 11), may be fabricated, processed, and incorporated into an electronic device, as described in the illustrative manufacturing process 1500. One or more aspects of the embodiments disclosed with respect to FIGS. 1-14 may be included at various processing stages, such as within the library file 1512, the GDSII file 1526, and the GERBER file 1552, as well as stored at the memory 1510 of the research computer 1506, the memory 1518 of the design computer 1514, the memory 1550 of the computer 1546, the memory of one or more other computers or processors (not shown) used at the various stages, such as at the board assembly process 1554, and also incorporated into one or more other physical embodiments such as the mask 1532, the die 1536, the package 1540, the PCA 1558, other products such as prototype circuits or devices (not shown), or any combination thereof. Although various representative stages are depicted with reference to FIGS. 1-14, in other embodiments fewer stages may be used or additional stages may be included. Similarly, the process 1500 of FIG. 15 may be performed by a single entity or by one or more entities performing various stages of the manufacturing process 1500.

In conjunction with the described embodiments, a non-transitory computer-readable medium stores instructions that, when executed by a processor, cause the processor to initiate formation of a magnetic core deposited as a discontinuous layer above a dielectric substrate. The magnetic core may include a first elongated portion. The magnetic core may further include a second elongated portion that is physically separated from the first elongated portion. The magnetic core may further include at least two curved portions that are physically separated from the first elongated portion and from the second elongated portion. The at least two curved portions may be substantially coplanar with the first elongated portion and the second elongated portion. The at least two curved portions, the first elongated portion, and the second elongated portion may be arranged to form a discontinuous loop. The non-transitory computer readable medium may further includes instructions that, when executed by the processor, cause the processor to initiate formation of a coil. A first portion of the coil may extend above a first surface of the magnetic core. A second portion of the coil may extend below a second surface of the magnetic core. The second surface of the magnetic core may be opposite the first surface of the magnetic core. The non-transitory computer-readable medium may correspond to the memory 1432 of FIG. 14 or to the memory 1510, the memory 1518, or the memory 1550 of FIG. 15. The processor may correspond to the processor 1412 of FIG. 14 or to the processor 1508, the processor 1516, or the processor 1548 of FIG. 15. The coil may correspond to the coil 106 of FIG. 1 or the coil formed by the first coil layer 602 or the second coil layer 604 of FIG. 6. The substrate may correspond to the dielectric substrate 302 of FIG. 3 or the combined substrate 1002 of FIG. 10. The magnetic core may correspond to the first magnetic core 102 or the second magnetic core 104 of FIG. 1, to the magnetic core 200 of FIG. 2, to the magnetic core formed by the first discontinuous layer 304 of FIG. 3, to the magnetic core formed by the second discontinuous layer 702 of FIG. 7, to the magnetic core formed by the second discontinuous layer 802 of FIG. 8, or to the magnetic core formed by the first interior discontinuous layer 1102, the second interior discontinuous layer 1104, or both, of FIG. 1.

In conjunction with the described embodiments, a non-transitory computer-readable medium stores instructions that, when executed by a processor, cause the processor to initiate formation of a magnetic core deposited as a discontinuous layer above a dielectric substrate. The magnetic core may be magnetically anisotropic. The magnetic core may include a plurality of physically separated segments disposed along an easy axis of the magnetic core. The non-transitory computer readable medium may further include instructions that, when executed by the processor, cause the processor to initiate formation of a coil. A first portion of the coil may extend above a first surface of the magnetic core. A second portion of the coil may extend below a second surface of the magnetic core. The second surface of the magnetic core may be opposite the first surface of the magnetic core. The non-transitory computer-readable medium may correspond to the memory 1432 of FIG. 14 or to the memory 1510, the memory 1518, or the memory 1550 of FIG. 15. The processor may correspond to the processor 1412 of FIG. 14 or to the processor 1508, the processor 1516, or the processor 1548 of FIG. 15. The coil may correspond to the coil 106 of FIG. 1 or the coil formed by the first coil layer 602 or the second coil layer 604 of FIG. 6. The substrate may correspond to the dielectric substrate 302 of FIG. 3 or the combined substrate 1002 of FIG. 10. The magnetic core may correspond to the first magnetic core 102 or the second magnetic core 104 of FIG. 1, to the magnetic core 200 of FIG. 2, to the magnetic core formed by the first discontinuous layer 304 of FIG. 3, to the magnetic core formed by the second discontinuous layer 702 of FIG. 7, to the magnetic core formed by the second discontinuous layer 802 of FIG. 8, or to the magnetic core formed by the first interior discontinuous layer 1102, the second interior discontinuous layer 1104, or both, of FIG. 11.

Those of skill would further appreciate that the various illustrative logical blocks, configurations, modules, circuits, and algorithm steps described in connection with the embodiments disclosed herein may be implemented as electronic hardware, computer software executed by a processor, or combinations of both. Various illustrative components, blocks, configurations, modules, circuits, and steps have been described above generally in terms of their functionality. Whether such functionality is implemented as hardware or processor executable instructions depends upon the particular application and design constraints imposed on the overall system. Skilled artisans may implement the described functionality in varying ways for each particular application, but such implementation decisions should not be interpreted as causing a departure from the scope of the present disclosure.

The steps of a method or algorithm described in connection with the embodiments disclosed herein may be embodied directly in hardware, in a software module executed by a processor, or in a combination of the two. A software module may reside in memory, such as random access memory (RAM), flash memory, read-only memory (ROM), programmable read-only memory (PROM), erasable programmable read-only memory (EPROM), electrically erasable programmable read-only memory (EEPROM), registers, hard disk, a removable disk, a compact disc read-only memory (CD-ROM). The memory may include any form of non-transient storage medium known in the art. An exemplary storage medium (e.g., memory) is coupled to the processor such that the processor can read information from, and write information to, the storage medium. In the alternative, the storage medium may be integral to the processor. The processor and the storage medium may reside in an application-specific integrated circuit (ASIC). The ASIC may reside in a computing device or a user terminal. In the alternative, the processor and the storage medium may reside as discrete components in a computing device or user terminal.

The previous description of the disclosed embodiments is provided to enable a person skilled in the art to make or use the disclosed embodiments. Various modifications to these embodiments will be readily apparent to those skilled in the art, and the principles defined herein may be applied to other embodiments without departing from the scope of the disclosure. Thus, the present disclosure is not intended to be limited to the embodiments shown herein but is to be accorded the widest scope possible consistent with the principles and novel features as defined by the following claims.

What is claimed is:

1. An apparatus comprising:

a dielectric substrate having a first surface and a second surface opposite the first surface; a first magnetic core comprising:

a first elongated portion:

a second elongated portion physically separate from the first elongated portion; and at least two curved portions physically separate from the first elongated portion and from the second elongated portion, the at least two curved portions being substantially coplanar with the first elongated portion and the second elongated portion, the at least two curved portions, the first elongated portion, and the second elongated portion forming a discontinuous loop on the first surface of the dielectric substrate; and a second magnetic core comprising:

a first elongated portion; a second elongated portion physically separate from the first elongated portion; and at least two curved portions physically separate from the first elongated portion and from the second elongated portion, the at least two curved portions being substantially coplanar with the first elongated portion and the second elongated portion, the at least two curved portions, the first elongated portion, and the second elongated portion forming a second discontinuous loop on the second surface of the dielectric substrate and a first coil including wherein a first portion of the first coil that extends above a first surface of the first magnetic core and above a first surface of the second magnetic core and a second portion of the first coil that extends below a second surface of the first magnetic core and below a second surface of the second magnetic core the second portion being coupled with the first portion.

2. The apparatus of claim 1, wherein:

the dielectric substrate includes a glass material, the first coil includes a conductive via that extends at least partially within the dielectric substrate, and the conductive via forms a portion of a turn of the first coil.

3. The apparatus of claim 1, wherein the second magnetic core is substantially symmetrical to the first magnetic core.

4. The apparatus of claim 1, wherein the dielectric substrate includes an alkaline earth boro-aluminosilicate glass, a glass-based laminate, sapphire ($Al_2O_3$), quartz, a ceramic, or a combination thereof.

5. The apparatus of claim 1, wherein at least one of the first magnetic core and the second magnetic core is formed includes Cobalt (Co), Iron (Fe), Tantalum (Ta), Zirconium (Zr), Nickel (Ni), Cobalt Iron (CoFe), Cobalt Tantalum Zirconium (CoTaZr), Nickel Iron (NiFe), or a combination thereof.

6. The apparatus of claim 1, wherein the first magnetic core has a racetrack toroid shape.

7. The apparatus of claim 6, wherein the second magnetic core has a racetrack toroid shape.

8. The apparatus of claim 1, wherein the first coil includes a plurality of conductive elements that coil around the first magnetic core.

9. The apparatus of claim 8, wherein the plurality of conductive elements of the first coil also around the second magnetic core.

10. The apparatus of claim 1, further comprising one or more electrical insulators between at least two of the separate portions of the first magnetic core.

11. The apparatus of claim 10, further comprising one or more electrical insulators between at least two of the separate portions of the second magnetic core.

12. The apparatus of claim 1, wherein the first magnetic core is a uniaxial core.

13. The apparatus of claim 12, wherein the second magnetic core is a uniaxial core.

14. The apparatus of claim 1, further comprising a second coil interspersed with the first coil, wherein a first portion of the second coil extends above the first surface of the first magnetic core and above the first surface of the second magnetic core, wherein a second portion of the second coil extends below the second surface of the first magnetic core and below the second surface of the second magnetic core and wherein the second portion of the second coil is coupled with the first portion of the second coil.

15. The apparatus of claim 14, wherein the first coil and the second coil form a transformer.

16. An electronic device comprising:

the apparatus of claim 1; and at least one die coupled with the apparatus of claim 1.

17. The electronic device of claim 16 the device being selected from a group consisting of a set top box, a music player, a video player, an entertainment unit, a navigation device, a communications device, a personal digital assistant (PDA), a fixed location data unit, and a computer.

18. An apparatus comprising:

a dielectric substrate having a first surface and a second surface opposite the first surface; a first magnetically anisotropic magnetic core on the first surface of the dielectric substrate the first magnetic core including a plurality of physically separate segments along an easy axis of the first magnetic core on the first surface of the dielectric substrate; a second magnetic core on the second surface of the dielectric substrate; and a first coil including a first portion that extends above a first surface of the first magnetic core and above a first surface of the second magnetic core, and a second portion that extends below a second surface of the first magnetic core and below a second surface of the second magnetic core, the second portion being coupled with the first portion.

19. The apparatus of claim 18, wherein: the dielectric substrate includes a glass material, the first coil includes a conductive via that extends at least partially within the dielectric substrate, and the conductive via forms a portion of a turn of the coil.

20. The apparatus of claim 18, wherein the second magnetic core is substantially symmetrical to the first magnetic core.

21. The apparatus of claim 18, wherein the dielectric substrate includes an alkaline earth boro-aluminosilicate glass, a glass-based laminate, sapphire ($Al_2O_3$), quartz, a ceramic, or a combination thereof.

22. The apparatus of claim 18, wherein at least one of the first magnetic core and the second magnetic core includes Cobalt (Co), Iron (Fe), Tantalum (Ta), Zirconium (Zr), Nickel (Ni), Cobalt Iron (CoFe), Cobalt Tantalum Zirconium (CoTaZr), Nickel Iron (NiFe), or a combination thereof.

23. The apparatus of claim 18, wherein the second magnetic core is a magnetically anisotropic magnetic core.

24. The apparatus of claim 18, wherein the second magnetic core includes a plurality of physically separate segments along an easy axis of the second magnetic core on the second surface of the dielectric substrate.

25. An electronic device comprising:

the apparatus of claim 18; and at least one die coupled with the apparatus of claim 18.

26. The electronic device of claim 25, the device being selected from a group consisting of a set top box, a music player, a video player, an entertainment unit, a navigation device, a communications device, a personal digital assistant (PDA), a fixed location data unit, and a computer.

27. The apparatus of claim 18, wherein the plurality of physically separate segments of the first magnetic core collectively have a racetrack toroid shape.

28. The apparatus of claim 27, wherein the second magnetic core has a racetrack toroid shape.

29. The apparatus of claim 18, wherein the coil includes a plurality of conductive elements that coil around the first magnetic core.

30. The apparatus of claim 29, wherein the plurality of conductive elements of the first coil also coil around the second magnetic core.

31. The apparatus of claim 18, further comprising one or more electrical insulators between at least two of the plurality of physically separate segments of the first magnetic core.

32. The apparatus of claim 31, wherein the second magnetic core includes a plurality of physically separate segments along an easy axis of the second magnetic core on the second surface of the dielectric substrate, and wherein the apparatus further comprises one or more electrical insulators between at least two of the plurality of physically separate segments of the second magnetic core.

33. The apparatus of claim 18, wherein the first magnetic core is a uniaxial core.

34. The apparatus of claim 33, wherein the second magnetic core is a uniaxial core.

35. The apparatus of claim 18, further comprising a second coil interspersed with the first coil, wherein a first portion of the second coil extends above the first surface of the first magnetic core and above the first surface of the second magnetic core, wherein a second portion of the second coil extends below the second surface of the first magnetic core and below the second surface of the second magnetic core, and wherein the second portion of the second coil is coupled with the first portion of the second coil.

36. The apparatus of claim 35, wherein the first coil and the second coil form a transformer.

37. An apparatus comprising:

dielectric supporting means having a first surface and a second surface opposite the first surface;

first means for guiding a magnetic field comprising:

a first elongated portion;

a second elongated portion physically separate from the first elongated portion;

at least two curved portions physically separate from the first elongated portion and from the second elongated portion, the at least two curved portions being substantially coplanar with the first elongated portion and the second elongated portion, the at least two curved portions, the first elongated portion, and the second elongated portion forming a discontinuous loop on the first surface of the dielectric supporting means; and second means for guiding the magnetic field comprising: a first elongated portion; a second elongated portion physically separate from the first elongated portion;

at least two curved portions physically separate from the first elongated portion and from the second elongated portion, the at least two curved portions being substantially coplanar with the first elongated portion and the second elongated portion the at least two curved portions, the first elongated portion, and the second elongated portion forming a second discontinuous loop on the second surface of the dielectric supporting means: and means for inducing a magnetic field including a first portion that extends above a first surface of the first means for guiding the magnetic field and above a first surface of the second means for guiding the magnetic field, and a second portion that extends below a second surface of the first means for guiding the magnetic field and below a second surface of the second means for guiding the magnetic field, the second portion being coupled with the first portion.

38. An electronic device comprising:

the apparatus of claim 37; and at least one die coupled with the apparatus of claim 37.

39. The electronic device of claim 38 the device being selected from a group consisting of a set top box, a music player, a video player, an entertainment unit, a navigation device, a communications device, a personal digital assistant (PDA), a fixed location data unit, and a computer.

40. An apparatus comprising:

dielectric supporting means having a first surface and a second surface opposite the first surface;

first magnetically anisotropic means for guiding a magnetic field, the first means for guiding the magnetic field being on the first surface of the dielectric supporting means, the first means for guiding the magnetic field including a plurality of physically separate segments along an easy axis of the first means for guiding the magnetic field, the plurality of physically separate segments being on the first surface of the dielectric supporting means; second means for guiding the magnetic field, the second means for guiding the magnetic field being on the second surface of the dielectric supporting means; and means for inducing a magnetic field including a first portion that extends above a first surface of the first means for guiding the magnetic field and above a first surface of the second means for guiding the magnetic field, and a second portion that extends below a second surface of the first means for guiding the magnetic field and below a second surface of the second means for guiding the magnetic field the second portion being coupled with first portion.

41. An electronic device comprising:

the apparatus of claim 40; and at least one die coupled with the apparatus of claim 40.

42. The electronic device of claim 41, the device being selected from a group consisting of a set top box, a music player, a video player, an entertainment unit, a navigation device, a communications device, a personal digital assistant (PDA), a fixed location data unit, and a computer.

* * * * *